US010767912B2

(12) United States Patent
Ito et al.

(10) Patent No.: US 10,767,912 B2
(45) Date of Patent: Sep. 8, 2020

(54) REFRIGERATION CYCLE APPARATUS

(71) Applicant: Mitsubishi Electric Corporation, Tokyo (JP)

(72) Inventors: Masahiro Ito, Tokyo (JP); Takuya Ito, Tokyo (JP); Yasushi Okoshi, Tokyo (JP); Kazuyuki Ishida, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 17 days.

(21) Appl. No.: 15/754,616

(22) PCT Filed: Oct. 8, 2015

(86) PCT No.: PCT/JP2015/078656
§ 371 (c)(1),
(2) Date: Feb. 23, 2018

(87) PCT Pub. No.: WO2017/061009
PCT Pub. Date: Apr. 13, 2017

(65) Prior Publication Data
US 2018/0252449 A1 Sep. 6, 2018

(51) Int. Cl.
*F25B 45/00* (2006.01)
*F25B 30/02* (2006.01)
(Continued)

(52) U.S. Cl.
CPC ..... *F25B 45/00* (2013.01); *F25B 13/00* (2013.01); *F25B 41/04* (2013.01); *F25B 43/00* (2013.01);
(Continued)

(58) Field of Classification Search
CPC ..... F25B 30/02; F25B 43/00; F25B 43/003; F25B 2500/23; F25B 2500/24; F25B 2600/05; F25B 45/00
See application file for complete search history.

(56) References Cited

U.S. PATENT DOCUMENTS 3,844,131 A * 10/1974 Gianni ..... F25B 1/047 62/149
4,084,405 A * 4/1978 Schibbye ..... F25B 1/047 62/197
(Continued)

FOREIGN PATENT DOCUMENTS

CN 101059288 A 10/2007
CN 104879940 A 9/2015
(Continued)

OTHER PUBLICATIONS

Extended EP Search Report dated Aug. 20, 2018 issued in corresponding EP patent application No. 15905828.8.
(Continued)

*Primary Examiner* — Frantz F Jules
*Assistant Examiner* — Erik Medoza-Wilkenfel
(74) *Attorney, Agent, or Firm* — Posz Law Group, PLC

(57) ABSTRACT

A refrigeration cycle apparatus is provided with a refrigerant circuit, a refrigerant tank circuit, and a degassing pipe. The refrigerant circuit is configured by connecting a compressor, a flow path switching apparatus, a first heat exchanger, a decompressing apparatus, and a second heat exchanger. The refrigerant tank circuit is connected to the first and second heat exchangers in parallel with the decompressing apparatus. The degassing pipe has a first end and a second end. The flow path switching apparatus is configured to switch a flow of refrigerant discharged from the compressor to any of the first and second heat exchangers. The refrigerant tank circuit contains a refrigerant tank. The degassing pipe has the first end connected to the refrigerant tank and has the second end connected to at least any of the refrigerant circuit and the refrigerant tank circuit.

3 Claims, 22 Drawing Sheets

(51) Int. Cl.

| | |
|---|---|
| ***F25B 43/00*** | (2006.01) |
| ***F25B 13/00*** | (2006.01) |
| ***F25B 49/02*** | (2006.01) |
| ***F25B 47/02*** | (2006.01) |
| ***F25B 41/04*** | (2006.01) |

(52) U.S. Cl.

CPC ..... *F25B 47/025* (2013.01); *F25B 49/02* (2013.01); *F25B 2313/003* (2013.01); *F25B 2341/0661* (2013.01); *F25B 2345/002* (2013.01); *F25B 2345/006* (2013.01); *F25B 2400/0411* (2013.01); *F25B 2400/0415* (2013.01); *F25B 2400/053* (2013.01); *F25B 2400/16* (2013.01); *F25B 2400/19* (2013.01); *F25B 2400/23* (2013.01); *F25B 2500/23* (2013.01); *F25B 2600/17* (2013.01); *F25B 2600/21* (2013.01); *F25B 2700/1931* (2013.01); *F25B 2700/1933* (2013.01); *F25B 2700/21151* (2013.01)

(56) References Cited

U.S. PATENT DOCUMENTS

| | | | | |
|---|---|---|---|---|
| 4,655,051 | A * | 4/1987 | Jones | F25B 13/00 62/324.4 |
| 4,831,835 | A * | 5/1989 | Beehler | F25B 41/04 62/196.1 |
| 6,615,597 | B1 | 9/2003 | Domyo et al. | |
| 2005/0247071 | A1* | 11/2005 | Nemit, Jr. | F25B 41/04 62/197 |
| 2011/0146313 | A1* | 6/2011 | Finckh | F25B 9/008 62/186 |
| 2012/0011866 | A1* | 1/2012 | Scarcella | F25B 1/10 62/79 |
| 2012/0227426 | A1* | 9/2012 | Deaconu | F25B 1/10 62/115 |
| 2013/0174595 | A1 | 7/2013 | Okuda et al. | |
| 2015/0362199 | A1 | 12/2015 | Yumoto et al. | |
| 2015/0377532 | A1* | 12/2015 | Uselton | F25B 45/00 62/77 |

FOREIGN PATENT DOCUMENTS

| | | | |
|---|---|---|---|
| JP | 2008-057807 | A | 3/2008 |
| JP | 2012-077983 | A | 4/2012 |
| JP | 2013-113498 | A | 6/2013 |
| JP | 2014-119145 | A | 6/2014 |
| JP | 2014-119153 | A | 6/2014 |
| JP | 2014-152943 | A | 8/2014 |
| WO | 02/46664 | A1 | 6/2002 |
| WO | 2014/119149 | A1 | 8/2014 |
| WO | 2015/053178 | A1 | 4/2015 |

OTHER PUBLICATIONS

Office Action dated Sep. 24, 2019 issued in corresponding CN patent appication No. 201580083766.3 (and English translation).

International Search Report of the International Searching Authority dated Dec. 22, 2015 for the corresponding International application No. PCT/JP2015/078656 (and English translation).

Extended European Search Report dated Jun. 30, 2020 issued in corresponding EP patent application No. 20166744.1.

* cited by examiner

REFRIGERATION CYCLE APPARATUS

CROSS REFERENCE TO RELATED APPLICATION

This application is a U.S. national stage application of PCT/JP2015/078656 filed on Oct. 8, 2015, the contents of which are incorporated herein by reference.

TECHNICAL FIELD

The present invention relates to a refrigeration cycle apparatus and particularly to a refrigeration cycle apparatus provided with a flow path switching apparatus configured to switch a flow of refrigerant discharged from a compressor to any of first and second heat exchangers.

BACKGROUND FIELD

Some refrigeration cycle apparatuses are configured to switch between cooling and heating by switching a flow of refrigerant discharged from a compressor to any of first and second heat exchangers. In such a refrigeration cycle apparatus, in general, a volume of a refrigerant flow path is greater in the first heat exchanger (an outdoor heat exchanger) than in the second heat exchanger (an indoor heat exchanger). In this case, since an optimal amount of refrigerant at which a coefficient of performance (COP) is maximized is greater in cooling than in heating, an amount of refrigerant is greater in cooling than in heating. Therefore, since an amount of refrigerant in cooling is excessive in heating, a refrigerant tank circuit which collects refrigerant excessive in heating to the refrigerant tank has been proposed. For example, Japanese Patent Laying-Open No. 2014-119153 (PTD 1) discloses such a refrigerant tank circuit. In an air conditioner described in this document, refrigerant excessive in heating is stored in a refrigerant tank (receiver) in the refrigerant tank circuit.

CITATION LIST

Patent Document

PTD 1: Japanese Patent Laying-Open No. 2014-119153

SUMMARY OF INVENTION

Technical Problem in the air conditioner described in the document, when refrigerant is collected to the refrigerant tank during cooling, the refrigerant is collected to the refrigerant tank in a gas-liquid two-phase state. Therefore, gas refrigerant in the refrigerant tank blocks inflow of liquid refrigerant. Since the refrigerant is not sufficiently collected to the refrigerant tank, the refrigerant excessive in heating remains in a refrigerant circuit. Therefore, when an operation of the air conditioner is switched from cooling to heating, liquid back which causes the liquid refrigerant to flow into the compressor is highly likely to occur.

Some refrigeration cycle apparatuses are provided with a defrosting mode for melting frost which adheres to the first heat exchanger (outdoor heat exchanger) which functions as an evaporator during heating. In the defrosting mode, refrigerant is circulated in a cycle the same as in cooling, that is, a cycle reverse to heating. Therefore, when the operation is switched from the defrosting mode to heating, liquid back is highly likely as in switching of the operation from cooling to heating.

The present invention was made in view of the problems above, and an object thereof is to provide a refrigeration cycle apparatus which can suppress occurrence of liquid back.

Solution to Problem

A refrigeration cycle apparatus according to the present invention comprises a refrigerant circuit, a refrigerant tank circuit, and a degassing pipe. The refrigerant circuit is configured by connecting a compressor, a flow path switching apparatus, a first heat exchanger, a decompressing apparatus, and a second heat exchanger. The refrigerant tank circuit is connected to the first and second heat exchangers in parallel with the decompressing apparatus. The degassing pipe has a first end and a second end. The flow path switching apparatus is configured to switch a flow of refrigerant discharged from the compressor to any of the first and second heat exchangers. The refrigerant tank circuit contains a refrigerant tank. The degassing pipe has the first end connected to the refrigerant tank and has the second end connected to at least any of the refrigerant circuit and the refrigerant tank circuit.

Advantageous Effects of Invention

According to the refrigeration cycle apparatus in the present invention, the refrigerant tank circuit is connected to the first and second heat exchangers in parallel with the decompressing apparatus. Therefore, the refrigerant is stored in the refrigerant tank and hence an amount of refrigerant which flows through the refrigerant circuit can be reduced. The refrigerant excessive in heating can thus be collected to the refrigerant tank. The degassing pipe has the first end connected to the refrigerant tank and has the second end connected to at least any of the refrigerant circuit and the refrigerant tank circuit. Therefore, the gas refrigerant in the refrigerant tank can escape through the degassing pipe. Therefore, blocking of inflow of liquid refrigerant by the gas refrigerant in the refrigerant tank is suppressed. Therefore, the liquid refrigerant can sufficiently be collected to the refrigerant tank. Thus, inflow into the compressor of the liquid refrigerant which flows in the refrigerant circuit can be suppressed. Therefore, occurrence of liquid back can be suppressed.

DESCRIPTION OF EMBODIMENTS

Embodiments of the present invention will be described below with reference to the drawings.

First Embodiment

A configuration of a refrigeration cycle apparatus in a first embodiment of the present invention will initially be described.

Figure 1:
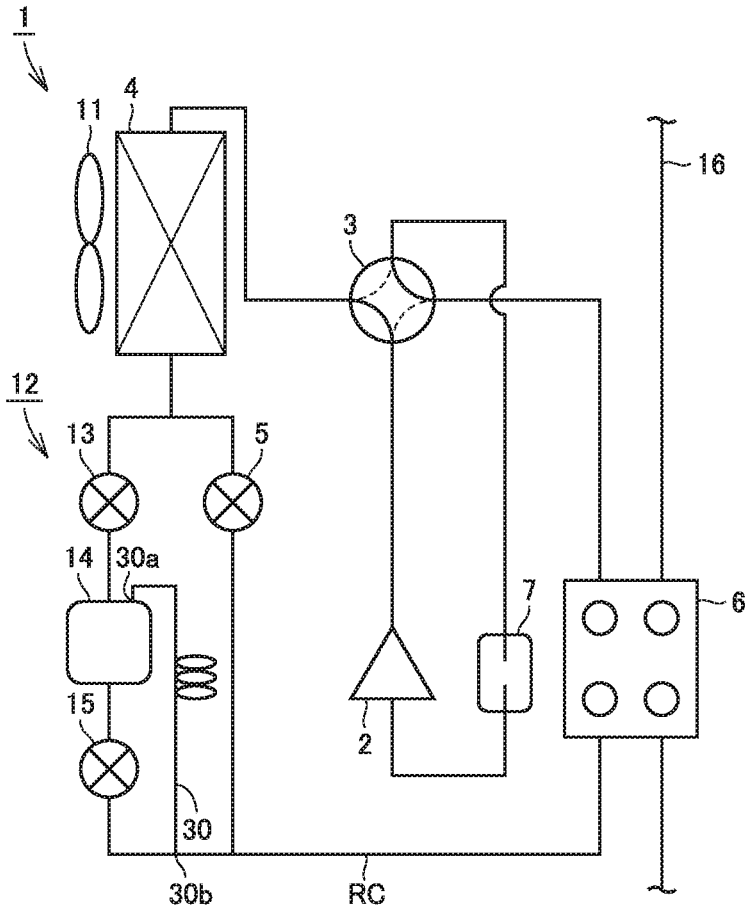
FIG. 1 is a circuit configuration diagram of one example of a refrigeration cycle apparatus in a first embodiment of the present invention.

Referring to FIG. 1, a refrigeration cycle apparatus 1 in the present embodiment mainly comprises a refrigerant circuit RC, a refrigerant tank circuit 12, and a degassing pipe 30. Refrigerant circuit RC and refrigerant tank circuit 12 implement a refrigeration circuit.

Refrigerant which varies in phase such as carbon dioxide or R410A circulates through the refrigeration circuit. Refrigeration cycle apparatus 1 exemplified in the first embodiment functions as a part of such a chilling unit that water in a water circuit 16 heated or cooled by a second heat exchanger 6 of refrigerant circuit RC is used for air conditioning of a room.

Refrigerant circuit RC is configured by connecting a compressor 2, a flow path switching apparatus 3, a first heat exchanger 4, a decompressing apparatus 5, second heat exchanger 6, and an accumulator 7 sequentially through a pipe.

Compressor 2 suctions and compresses low-pressure refrigerant and discharges the refrigerant as high-pressure refrigerant. Compressor 2 is, for example, an inverter compressor of which volume of discharge of refrigerant is variable. An amount of circulation of refrigerant in refrigeration cycle apparatus 1 is controlled by regulating a volume of discharge from compressor 2.

Flow path switching apparatus 3 is provided on a discharge side of compressor 2. Flow path switching apparatus 3 is configured to switch a flow of refrigerant discharged from compressor 2 to any of first heat exchanger 4 and second heat exchanger 6. Flow path switching apparatus 3 selectively performs an operation to allow connection of the discharge side of compressor 2 to first heat exchanger 4 and connection of a suction side of compressor 2 to second heat exchanger 6 so as to allow the refrigerant discharged from compressor 2 to flow to first heat exchanger 4 and an operation to allow connection of the discharge side of compressor 2 to second heat exchanger 6 and connection of the suction side of compressor 2 to first heat exchanger 4 so as to allow the refrigerant discharged from compressor 2 to flow to second heat exchanger 6. Flow path switching apparatus 3 is an apparatus which has a valve disc provided in a pipe through which refrigerant flows and switches a flow path for the refrigerant as described above by switching between an opened state and a closed state of the valve disc.

First heat exchanger 4 is a refrigerant-air heat exchanger having a flow path through which refrigerant flows. In first heat exchanger 4, heat is exchanged between the refrigerant which flows through the flow path and air outside the flow path. A fan 11 is provided in the vicinity of first heat exchanger 4. Fan 11 serves to send air to first heat exchanger 4. Heat exchange in first heat exchanger 4 is promoted by air from fan 11. Fan 11 is, for example, a fan of which rotation speed is variable, and an amount of heat absorption by the refrigerant in first heat exchanger 4 is adjusted based on adjustment of a rotation speed of fan 11.

Decompressing apparatus 5 reduces a pressure of high-pressure refrigerant. An apparatus provided with a valve disc of which opening position can be adjusted, such as an electronically controlled expansion valve, can be employed as decompressing apparatus 5.

Second heat exchanger 6 is a refrigerant-water heat exchanger having a flow path through which refrigerant flows and a flow path through which water of water circuit 16 flows. In second heat exchanger 6, heat is exchanged between the refrigerant and water. A plate-type heat exchanger can be employed as second heat exchanger 6.

Refrigeration cycle apparatus 1 can operate while switching between cooling and heating. In a cooling mode, flow path switching apparatus 3 allows connection of the discharge side of compressor 2 to first heat exchanger 4. The refrigerant discharged from compressor 2 flows to first heat exchanger 4. First heat exchanger 4 functions as a condenser and second heat exchanger 6 functions as an evaporator. In a heating mode, flow path switching apparatus 3 allows connection of the discharge side of compressor 2 to second heat exchanger 6. The refrigerant discharged from compressor 2 flows to second heat exchanger 6. First heat exchanger 4 functions as an evaporator and second heat exchanger 6 functions as a condenser. First heat exchanger 4 functions as a heat source side heat exchanger and second heat exchanger 6 functions as a use side heat exchanger. Taking into account a load required in the cooling mode and the heating triode, first heat exchanger 4 is higher in capacity of heat exchange than second heat exchanger 6.

Accumulator 7 is a container in which refrigerant is stored, and it is placed on the suction side of compressor 2. A pipe in which the refrigerant flows is connected to an upper portion of accumulator 7 and a pipe out of which the refrigerant flows is connected to a lower portion of the accumulator. The refrigerant is subjected to gas-liquid separation in accumulator 7. Gas refrigerant resulting from gas-liquid separation is suctioned into compressor 2.

Refrigerant tank circuit 12 is connected to first heat exchanger 4 and second heat exchanger 6 in parallel with decompressing apparatus 5. Refrigerant tank circuit 12 is a circuit which connects first heat exchanger 4 and decompressing apparatus 5 to each other and connects decompressing apparatus 5 and second heat exchanger 6 to each other. Refrigerant tank circuit 12 comprises a flow rate regulation apparatus 13, a refrigerant tank 14, and a valve 15. Refrigerant tank circuit 12 is configured connecting flow rate regulation apparatus 13, refrigerant tank 14, and valve 15 in series through a pipe in the order of proximity to first heat exchanger 4.

Flow rate regulation apparatus 13 reduces a pressure of high-pressure refrigerant. An apparatus provided with a valve disc of which opening position can be adjusted, such as an electronically controlled expansion valve, can be employed as flow rate regulation apparatus 13.

Figure 2:
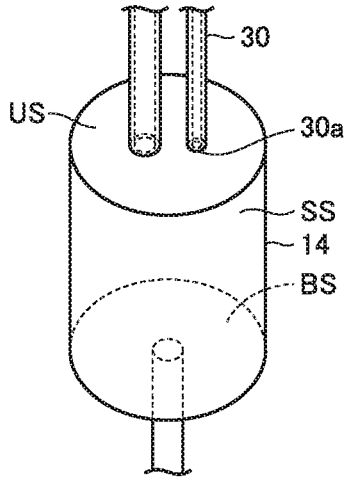
FIG. 2 is a perspective view schematically showing a configuration of a refrigerant tank in the refrigeration cycle apparatus in the first embodiment of the present invention.

Refrigerant tank 14 is a container in which refrigerant is stored. Refrigerant tank 14 can be, for example, columnar. As shown in FIG. 2, refrigerant tank 14 has an upper surface US, a bottom surface BS, and a side surface SS which connects upper surface US and bottom surface BS to each other.

Valve 15 has a valve disc provided in a pipe which constitutes refrigerant tank circuit 12 and switches between a conducting state and a non-conducting state of refrigerant by switching between an opened state and a closed state of the valve disc. For example, a bidirectional solenoid valve, an electronically controlled expansion valve of which opening position can be adjusted, or a valve unit in which a unidirectional solenoid valve and a check valve are provided in parallel can be employed as valve 15.

Referring to FIGS. 1 and 2, degassing pipe 30 serves to evacuate gas refrigerant from refrigerant tank 14. A capillary tube can be employed for degassing pipe 30. Degassing pipe 30 may have a helically constructed portion. Since impact can thus be absorbed, break can be suppressed.

Degassing pipe 30 has a first end 30*a* and a second end 30*b*. Degassing pipe 30 has first end 30*a* connected to refrigerant tank 14 and has second end 30*b* connected to at least any of refrigerant circuit RC and refrigerant tank circuit 12. Degassing pipe 30 has first end 30*a* connected to an upper portion of refrigerant tank 14. In FIG. 2, degassing pipe 30 has first end 30*a* connected to upper surface US of refrigerant tank 14. Degassing pipe 30 may have first end 30*a* connected to side surface SS of refrigerant tank 14. Degassing pipe 30 should only have first end 30*a* arranged at a height position above bottom surface BS of refrigerant tank 14.

Degassing pipe 30 has second end 30*b* connected to at least any of refrigerant circuit RC and refrigerant tank circuit 12 between refrigerant tank 14 and second heat exchanger 6. In FIG. 1, degassing pipe 30 has second end 30*b* connected to refrigerant tank circuit 12 between refrigerant tank 14 and second heat exchanger 6. Degassing pipe 30 has second end 30*b* connected downstream from valve 15 in refrigerant circuit RC. Degassing pipe 30 may have a plurality of second ends 30*b*. In this case, at least one of the plurality of second ends 30*b* may be connected to refrigerant circuit RC and at least another one of the plurality of second ends 30*b* may be connected to refrigerant tank circuit 12.

A pipe which connects flow rate regulation apparatus 13 and refrigerant tank 14 to each other is connected to upper surface US of refrigerant tank 14. A pipe which connects valve 15 and refrigerant tank 14 to each other is connected to bottom surface BS of refrigerant tank 14.

Figure 3:
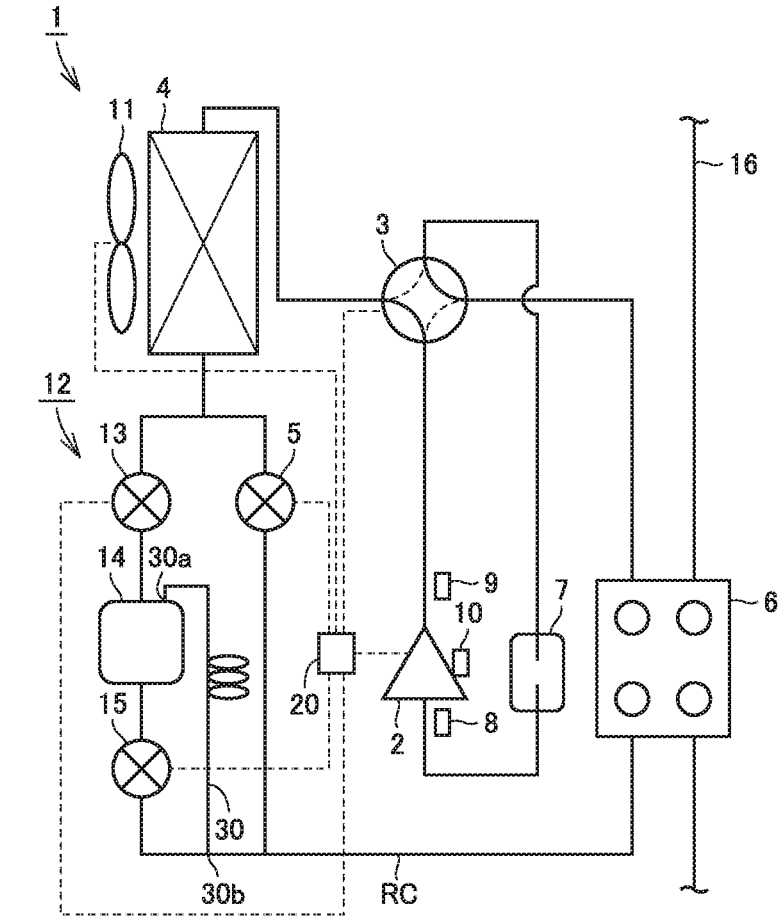
FIG. 3 is a circuit configuration diagram of another example of the refrigeration cycle apparatus in the first embodiment of the present invention.

Referring to FIG. 3, refrigeration cycle apparatus 1 in the present embodiment may have a suction pressure sensor 8, a discharge pressure sensor 9, a suction temperature sensor 10, and a control device 20.

Suction pressure sensor 8 which detects a pressure of refrigerant suctioned into compressor 2, that is, refrigerant on a low-pressure side, is provided at a suction portion of compressor 2. Suction pressure sensor 8 is provided at a position where it can detect a pressure of the refrigerant on the low-pressure side and an illustrated position of suction pressure sensor 8 is by way of example.

Discharge pressure sensor 9 which detects a pressure of the refrigerant discharged from compressor 2, that is, the refrigerant on a high-pressure side, is provided at a discharge portion of compressor 2. Discharge pressure sensor 9 is provided at a position where it can detect a pressure of the refrigerant on the high-pressure side and the illustrated position of discharge pressure sensor 9 is by way of example.

Suction temperature sensor 10 which detects a temperature of refrigerant suctioned into compressor 2, that is, the refrigerant on the low-pressure side, is provided in the suction portion of compressor 2. Suction temperature sensor 10 is provided at a position where it can detect a temperature of the refrigerant on the low-pressure side and the illustrated position of suction temperature sensor 10 is by way of example. Suction temperature sensor 10 is provided, for example, in a pipe in a lower portion of a shell of compressor 2 or on an inlet side of accumulator 7.

Figure 4:
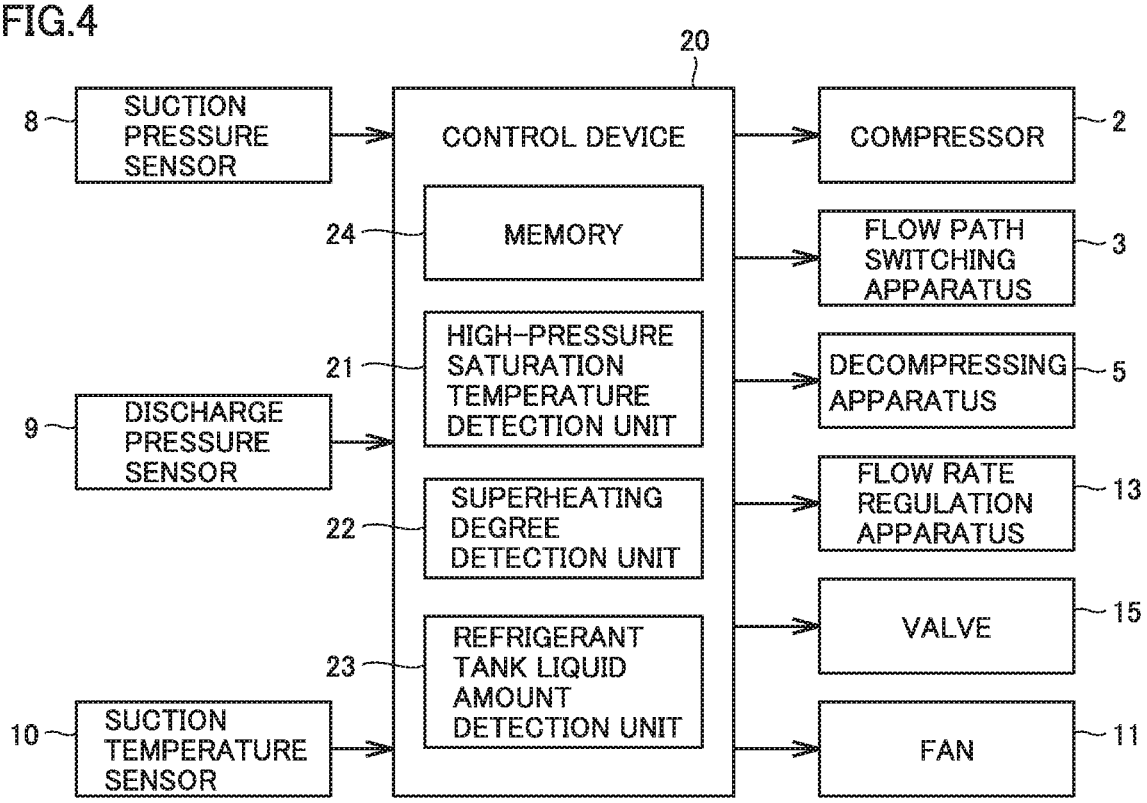
FIG. 4 is a functional block diagram for illustrating a configuration of a control device in the refrigeration cycle apparatus in the first embodiment of the present invention.

Referring to FIGS. 3 and 4, control device 20 is responsible for overall control of refrigeration cycle apparatus 1. Information detected by suction pressure sensor 8, discharge pressure sensor 9, and suction temperature sensor 10 is input to control device 20. Control device 20 controls operations of compressor 2, flow path switching apparatus 3, decompressing apparatus 5, flow rate regulation apparatus 13, valve 15, and fan 11.

Control device 20 has a high-pressure saturation temperature detection unit 21, a superheating degree detection unit 22, and a refrigerant tank liquid amount detection unit 23 as functional blocks. Control device 20 has a memory 24.

High-pressure saturation temperature detection unit 21 detects a high-pressure saturation temperature which represents a saturation temperature of high-pressure refrigerant on the discharge side of compressor 2 based on a pressure of the high-pressure refrigerant detected by discharge pressure sensor 9 and a conversion table of saturation temperatures under various pressures stored in memory 24.

Superheating degree detection unit 22 detects a saturation temperature of refrigerant on the suction side based on a pressure of the refrigerant on the suction side of compressor 2 detected by suction pressure sensor 8 and the conversion table of saturation temperatures under various pressures stored in memory 24. Superheating degree detection unit 22 detects a degree of superheating in the suction portion of compressor 2 by calculating a difference between the detected saturation temperature and the temperature of the refrigerant in the suction portion of compressor 2 detected by suction temperature sensor 10.

Refrigerant tank liquid amount detection unit 23 detects an amount of liquid in refrigerant tank 14 based on the degree of superheating in the suction portion of compressor 2 detected by superheating degree detection unit 22 and a reference degree of superheating at the time when refrigerant tank 14 is full which is stored in memory 24.

Control device 20 is implemented by a CPU (a central processing unit which is also referred to as a central processor, a processing device, an operation device, a microprocessor, a microcomputer, or a processor) which executes a program stored in memory 24.

When control device 20 is implemented by the CPU, each function performed by control device 20 is performed by software, firmware, or combination of software and firmware. Software or firmware is described as a program and stored in memory 24. The CPU performs each function of control device 20 by reading and executing the program stored in memory 24. Memory 24 is, for example, a non-volatile or volatile semiconductor memory such as a RAM, a ROM, a flash memory, an EPROM, or an EEPROM.

High-pressure saturation temperature detection unit 21, superheating degree detection unit 22, and refrigerant tank liquid amount detection unit 23 of control device 20 may be implemented partially by dedicated hardware and partially by software or firmware. When they are implemented by hardware, for example, a single circuit, a composite circuit, an ASIC, an FPGA, or combination thereof is employed.

An operation mode of the refrigeration cycle apparatus in the present embodiment will now be described. In each figure, a path through which refrigerant flows is shown with a bold line and a direction of flow of the refrigerant is shown with an arrow as appropriate.

[Cooling Mode]

Figure 5:
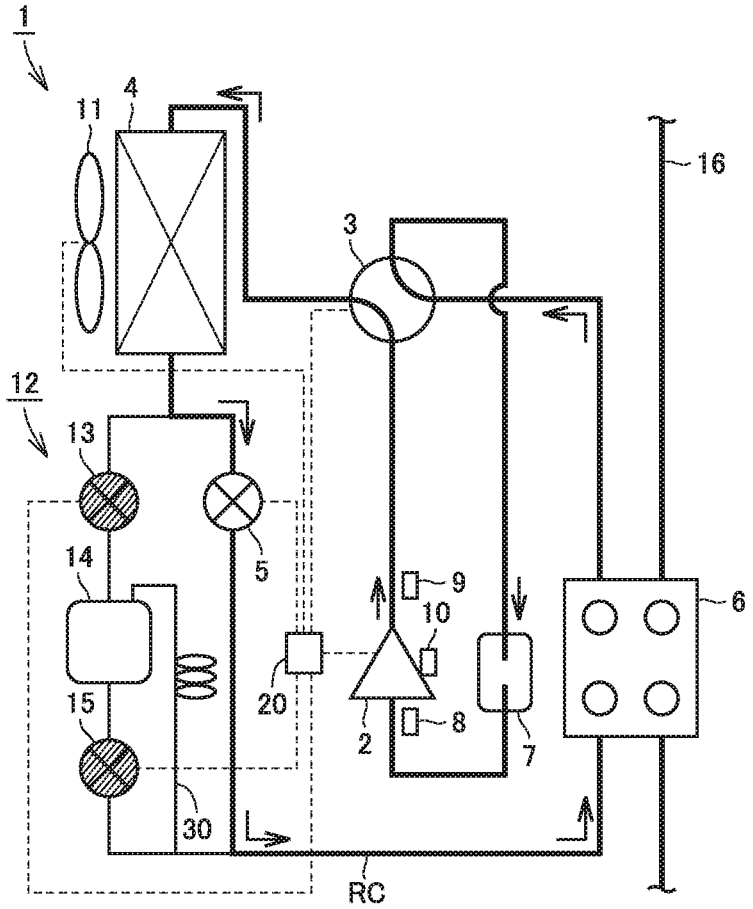
FIG. 5 is a circuit configuration diagram showing a flow of refrigerant in a cooling mode of the refrigeration cycle apparatus in the first embodiment of the present invention.

A flow of refrigerant in the cooling mode will be described with reference to FIG. 5. The refrigerant at a high temperature and a high pressure discharged from compressor 2 flows into first heat exchanger 4 through flow path switching apparatus 3. The refrigerant at a high temperature and a high pressure exchanges heat with air sent from fan 11 in first heat exchanger 4 to decrease in temperature, and flows out of first heat exchanger 4. The refrigerant which flows out of first heat exchanger 4 is reduced in pressure in decompressing apparatus 5 to become refrigerant at a low temperature and a low pressure, and flows into second heat exchanger 6. The refrigerant at a low temperature and a low pressure exchanges heat with water which flows through water circuit 16 in second heat exchanger 6 to increase in temperature, and flows out of second heat exchanger 6. The refrigerant which flows out of second heat exchanger 6 flows into accumulator 7 through flow path switching apparatus 3 and subjected to gas-liquid separation in accumulator 7. Gas refrigerant in accumulator 7 is suctioned into compressor 2.

Thus, in the cooling mode, the refrigerant which flows through second heat exchanger 6 defined as the use side heat exchanger cools water which flows through water circuit 16 and this cooled water is used for cooling of the room.

An optimal amount of refrigerant in a rated operation in the cooling mode is greater than an optimal amount of refrigerant in a rated operation in the heating mode. Therefore, in the cooling mode, the refrigerant is not stored in refrigerant tank 14 but a total amount of refrigerant circulates through refrigeration cycle apparatus 1. In the cooling mode, flow rate regulation apparatus 13 and valve 15 are frilly closed or in a state close to the fully closed state, and no refrigerant flows into or out of refrigerant tank circuit 12.

[Cooling Mode-Refrigerant Collection Operation]

An optimal amount of refrigerant in the rated operation in the heating mode is smaller than an optimal amount of refrigerant in the rated operation in the cooling mode. Therefore, when the operation mode is switched from the cooling mode to the heating mode, a refrigerant collection operation in which the refrigerant excessive in the heating mode is collected to refrigerant tank 14 is performed in the cooling mode.

Figure 6:
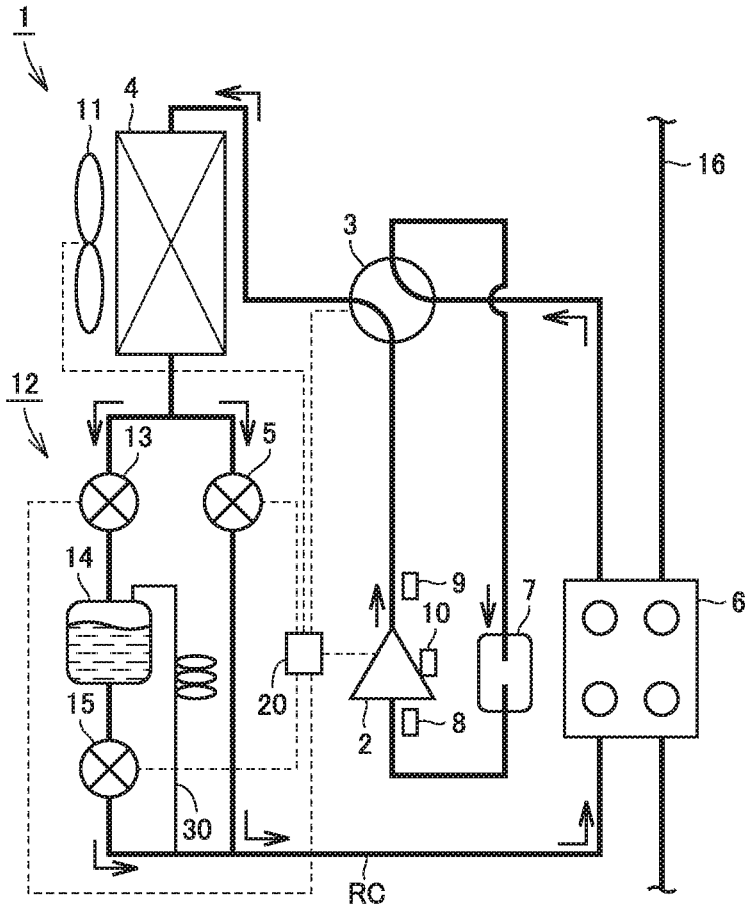
FIG. 6 is a circuit configuration diagram showing a flow of refrigerant in one example of a refrigerant collection operation in the cooling mode and a defrosting mode of the refrigeration cycle apparatus in the first embodiment of the present invention.

Referring to FIG. 6, in the refrigerant collection operation, flow rate regulation apparatus 13 and valve 15 are opened. Flow path switching apparatus 3 is maintained in a state that the discharge side of compressor 2 is connected to first heat exchanger 4. Some of the refrigerant which flows from first heat exchanger 4 is branched upstream from decompressing apparatus 5 and flows into flow rate regulation apparatus 13. The refrigerant is reduced in pressure in flow rate regulation apparatus 13 so that some of the refrigerant is converted to liquid refrigerant. The liquid refrigerant is stored in refrigerant tank 14.

Figure 7:
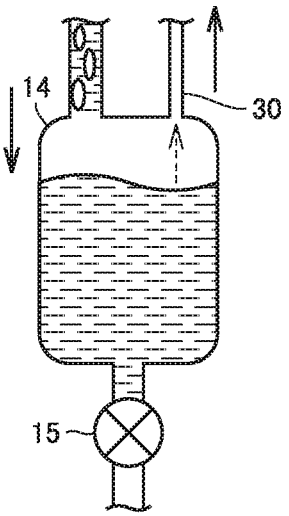
FIG. 7 is a cross-sectional view showing a flow of refrigerant in a cooling collection operation in the refrigerant tank of the refrigeration cycle apparatus in the first embodiment of the present invention.

Referring to FIGS. 6 and 7, gas refrigerant flows into refrigerant tank 14 together with the liquid refrigerant. The gas refrigerant flows out of refrigerant tank 14 through degassing pipe 30. The gas refrigerant flows through degassing pipe 30 toward second heat exchanger 6. Since the gas refrigerant in refrigerant tank 14 escapes through degassing pipe 30, the liquid refrigerant can sufficiently be stored in refrigerant tank 14. When refrigerant tank 14 is filled up with the liquid refrigerant, the refrigerant collection operation ends. The filled up state means a state that eighty percent or more of a volume of refrigerant tank 14 is filled with liquid refrigerant.

Figure 8:
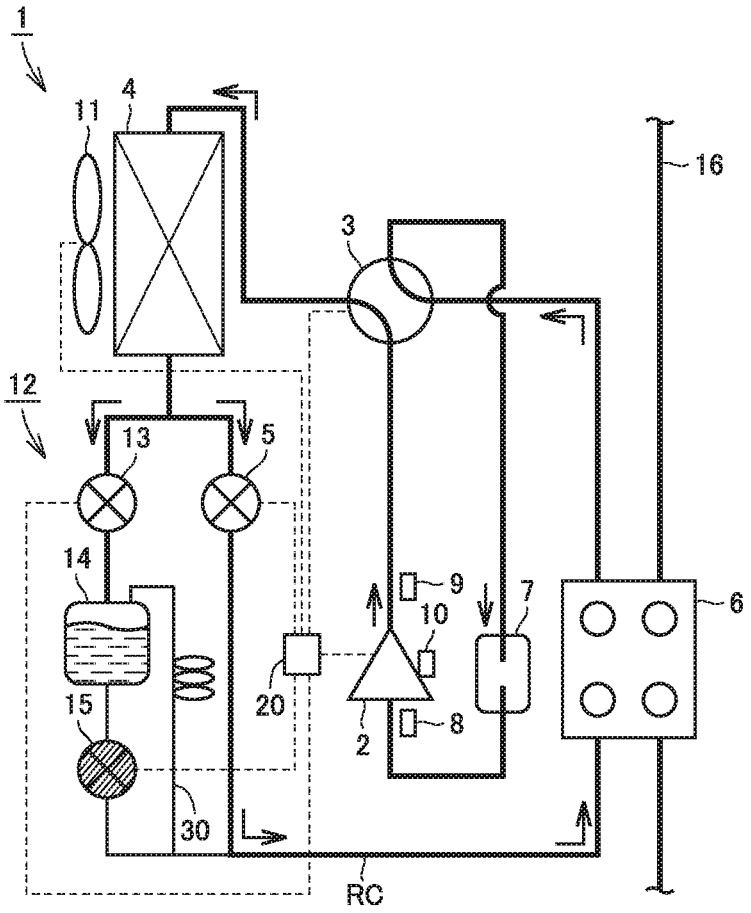
FIG. 8 is a circuit configuration diagram showing a flow of refrigerant in another example of the refrigerant collection operation in the cooling mode and the defrosting mode of the refrigeration cycle apparatus in the first embodiment of the present invention.

Referring to FIG. 8, in the refrigerant collection operation, flow rate regulation apparatus 13 may be opened and valve 15 may be closed. Since valve 15 is closed in this case, the liquid refrigerant is more readily stored in refrigerant tank 14.

[Heating Mode]

Figure 9:
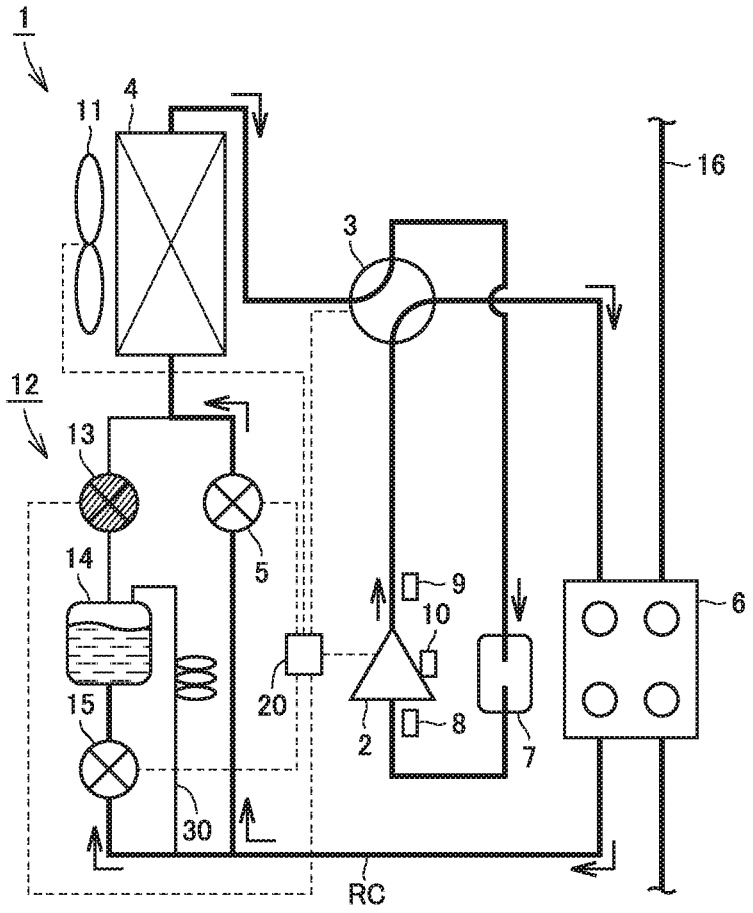
FIG. 9 is a circuit configuration diagram showing a flow of refrigerant in a heating mode of the refrigeration cycle apparatus in the first embodiment of the present invention.

A flow of refrigerant in the heating mode will be described with reference to FIG. 9. The refrigerant at a high temperature and a high pressure discharged from compressor 2 flows into second heat exchanger 6 through flow path switching apparatus 3. The refrigerant at a high temperature and a high pressure exchanges heat with water which flows through water circuit 16 in second heat exchanger 6 to decrease in temperature, and flows out of second heat exchanger 6. The refrigerant which flows out of second heat exchanger 6 is reduced in pressure in decompressing apparatus 5 to become refrigerant at a low temperature and a low pressure, and flows into first heat exchanger 4. The refrigerant at a low temperature and a low pressure exchanges heat with air sent from fan 11 in first heat exchanger 4 to increase in temperature, and flows out of first heat exchanger 4. The refrigerant which flows out of first heat exchanger 4 flows into accumulator 7 through flow path switching apparatus 3 and is subjected to gas-liquid separation in accumulator 7. Gas refrigerant in accumulator 7 is suctioned into compressor 2.

Thus, in the heating mode, the refrigerant which flows through second heat exchanger 6 defined as the use side heat exchanger heats water which flows through water circuit 16 and heated water is used for heating a room.

In the heating mode, flow rate regulation apparatus 13 is fully closed or in a state close to the fully closed state, and valve 15 is fully opened. As described above, the refrigerant excessive during an operation in the heating mode is stored in refrigerant tank 14 and an amount of refrigerant which circulates through refrigerant circuit RC in the heating mode is smaller than an amount of refrigerant which circulates through refrigerant circuit RC in the cooling mode.

In the present embodiment, in both of the cooling mode and the heating mode described above, control device 20 controls decompressing apparatus 5 to set a degree of superheating. More specifically, superheating degree detection unit 22 of control device 20 detects a degree of superheating of refrigerant on an exit side of the heat exchanger which functions as the condenser, that is, on the suction side of compressor 2, and control device 20 controls an opening position of decompressing apparatus 5 such that the detected degree of superheating is close to a target value.

[Defrosting Mode]

During an operation in the heating mode, frost may adhere to an outer surface of a pipe of first heat exchanger 4 which functions as the evaporator. Therefore, refrigeration cycle apparatus 1 operates in a defrosting mode in order to melt the frost that adheres. In the defrosting mode, as in the cooling mode, flow path switching apparatus 3 allows connection of the discharge side of compressor 2 to first heat exchanger 4 so as to allow refrigerant at a high temperature discharged from compressor 2 to flow to first heat exchanger 4. Heat of the refrigerant thus melts frost. In the defrosting mode, the refrigerant at a low temperature flows into second heat exchanger 6 defined as the use side heat exchanger and therefore the defrosting mode desirably ends as early as possible.

Since an optimal amount of refrigerant is different between the cooling mode and the heating mode as described above, refrigeration cycle apparatus 1 operates in the heating mode with excessive refrigerant being stored in refrigerant tank 14. In order to quit the defrosting mode in a short period of time, on the other hand, capability in the defrosting mode is desirably enhanced. In the present embodiment, in the defrosting mode, refrigerant in refrigerant tank 14 is released from refrigerant tank 14 to circulate, to thereby enhance defrosting capability. Therefore, when the operation mode returns from the defrosting mode to the heating mode, the refrigerant collection operation in which the refrigerant excessive in the heating mode is collected to refrigerant tank 14 is performed. The refrigerant collection operation in the defrosting mode is similar to the refrigerant collection operation in the cooling mode described above.

In succession, the defrosting mode will be described in further detail.

Figure 10:
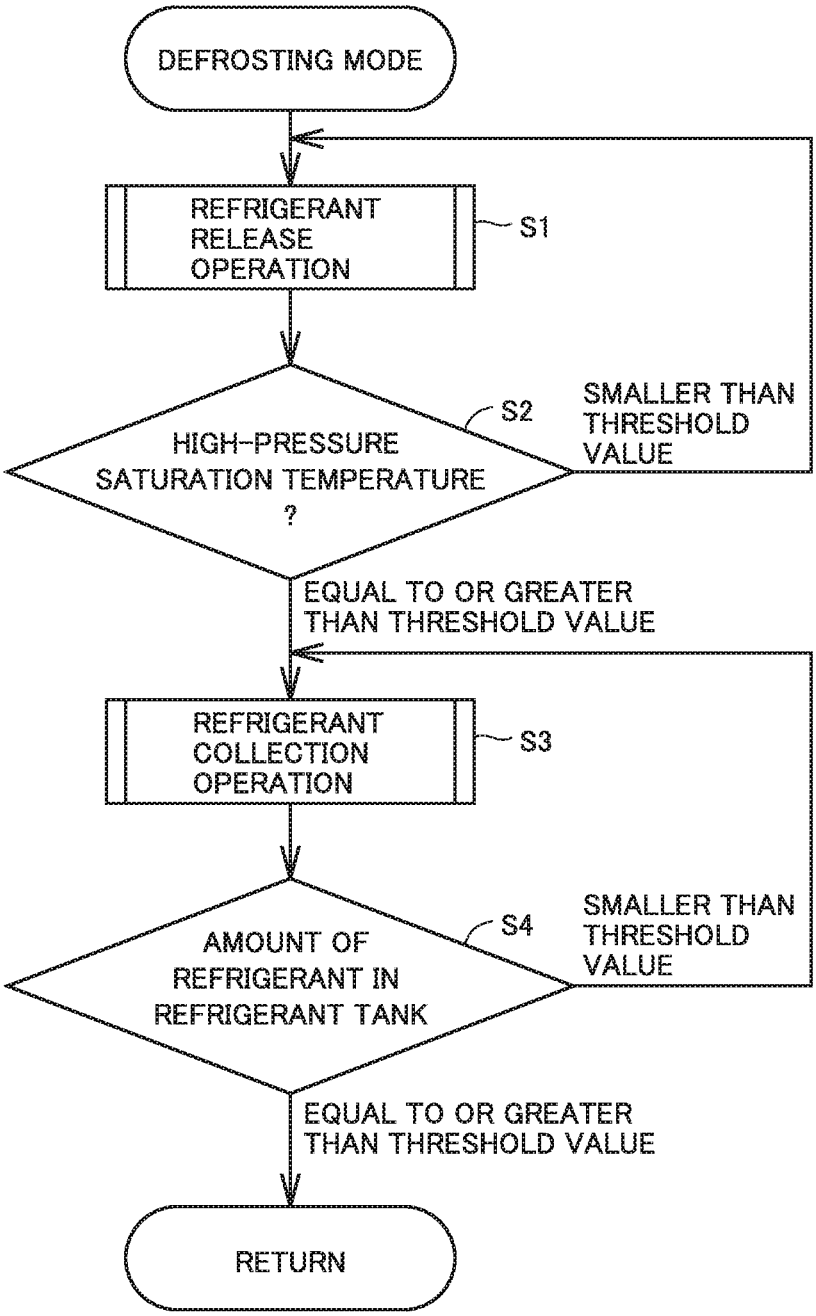
FIG. 10 is a flowchart for illustrating a flow in the defrosting mode of the refrigeration cycle apparatus in the first embodiment of the present invention.

A general flow in the defrosting mode will be described with reference to FIG. 10. When control device 20 starts the defrosting mode, it performs a refrigerant release operation in which refrigerant in refrigerant tank 14 is released by opening one of flow rate regulation apparatus 13 and valve 15 (S1). In this refrigerant release operation, the refrigerant discharged from compressor 2 flows to first heat exchanger 4. When a high-pressure saturation temperature is equal to or greater than a threshold value (S2), control device 20 determines that defrosting is completed and performs the refrigerant collection operation for collecting the refrigerant to refrigerant tank 14 by opening both of flow rate regulation apparatus 13 and valve 15 (S3). When an amount of liquid in refrigerant tank 14 reaches the threshold value (S4), control device 20 quits the defrosting mode and returns to the heating mode.

An operation in the defrosting mode will further be described below with reference to FIGS. 11 to 15.

Figure 11:
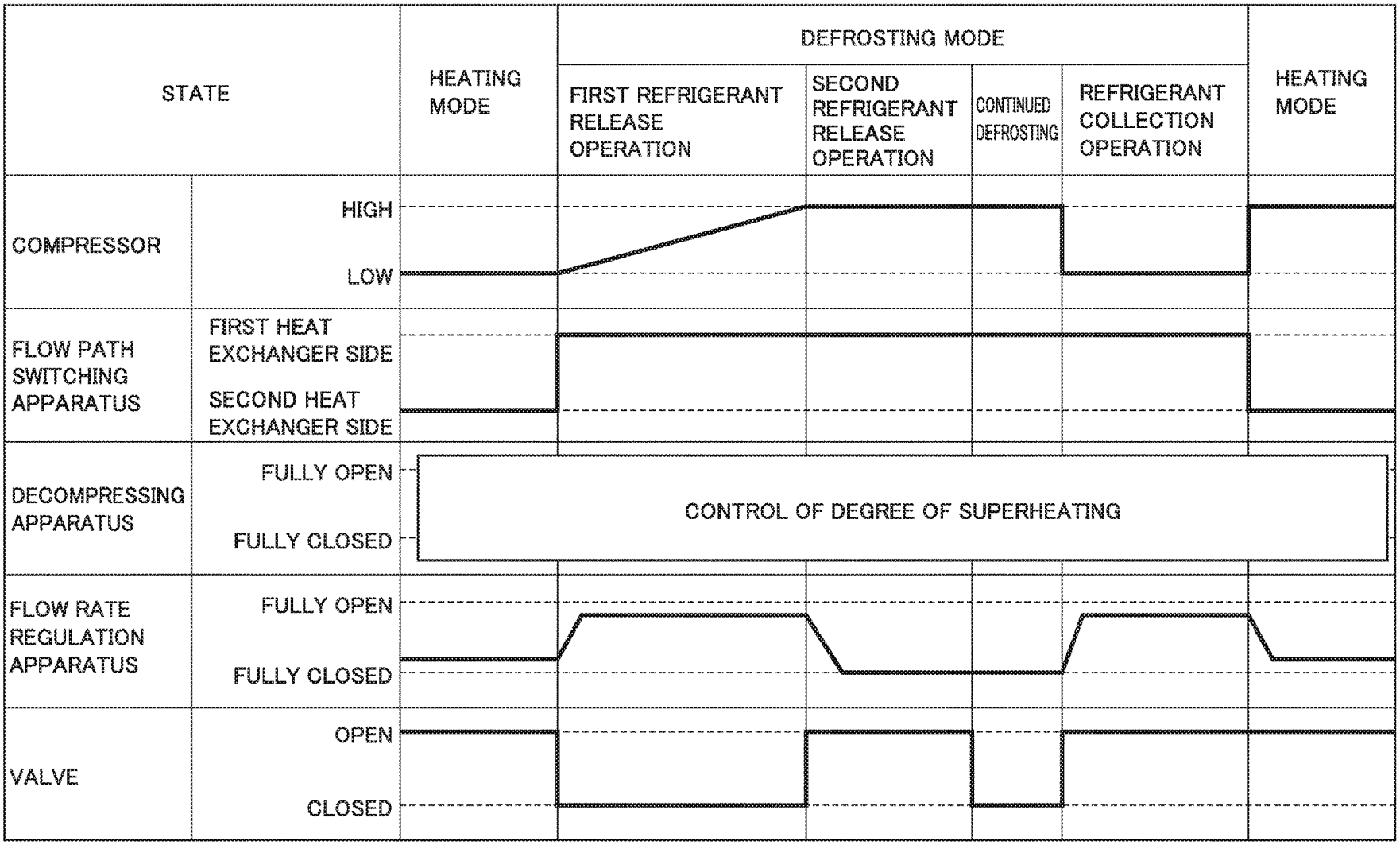
FIG. 11 is a timing chart for illustrating an operation of an actuator in the defrosting mode of the refrigeration cycle apparatus in the first embodiment of the present invention.

As shown in FIG. 11, in the heating mode, compressor 2 operates at a capacity determined based on a load in air conditioning. Flow path switching apparatus 3 allows connection of the discharge side of compressor 2 to second heat exchanger 6. Decompressing apparatus 5 is set to an opening position at which a degree of superheating is controlled. Flow rate regulation apparatus 13 of refrigerant tank circuit 12 is fully closed or in a state close to the fully closed state. Valve 15 is opened. Flow rate regulation device 13 and valve 15 should only be in such a state that refrigerant tank 14 can be maintained in a full state in the heating mode and limitation to the example in FIG. 11 is not intended. Refrigeration cycle apparatus 1 in the heating mode is as shown in FIG. 9.

[Defrosting Mode-First Refrigerant Release Operation]

When the defrosting mode is started, a first refrigerant release operation is initially performed. In the first refrigerant release operation, flow path switching apparatus 3 allows connection of the discharge side of compressor 2 to first heat exchanger 4 so that flow rate regulation apparatus 13 is controlled to the opened state and valve 15 is controlled to the closed state. Flow rate regulation apparatus 13 may fully be opened or may be set to an opening position slightly lower than the fully opened state in order to suppress liquid back to compressor 2. A degree of superheating of decompressing apparatus 5 is controlled also in the defrosting mode. Though compressor 2 is enhanced in operation capacity for enhancing defrosting capability in the example in FIG. 11, control of capability of compressor 2 is not limited.

When the first refrigerant release operation is started as shown with a point. A in FIG. 12, relation in terms of high and low pressures is inverted with switching of a flow path by flow path switching apparatus 3 and hence a high-pressure saturation temperature is low. Though a low-pressure saturation temperature is lowered with lowering in high-pressure saturation temperature, a differential pressure is low because a temperature of water in water circuit 16 which flows through second heat exchanger 6 is high owing to a function in the heating mode before start of the defrosting mode. Therefore, as shown with a point B, a degree of superheating in the suction portion of compressor 2 is high.

Figure 12:
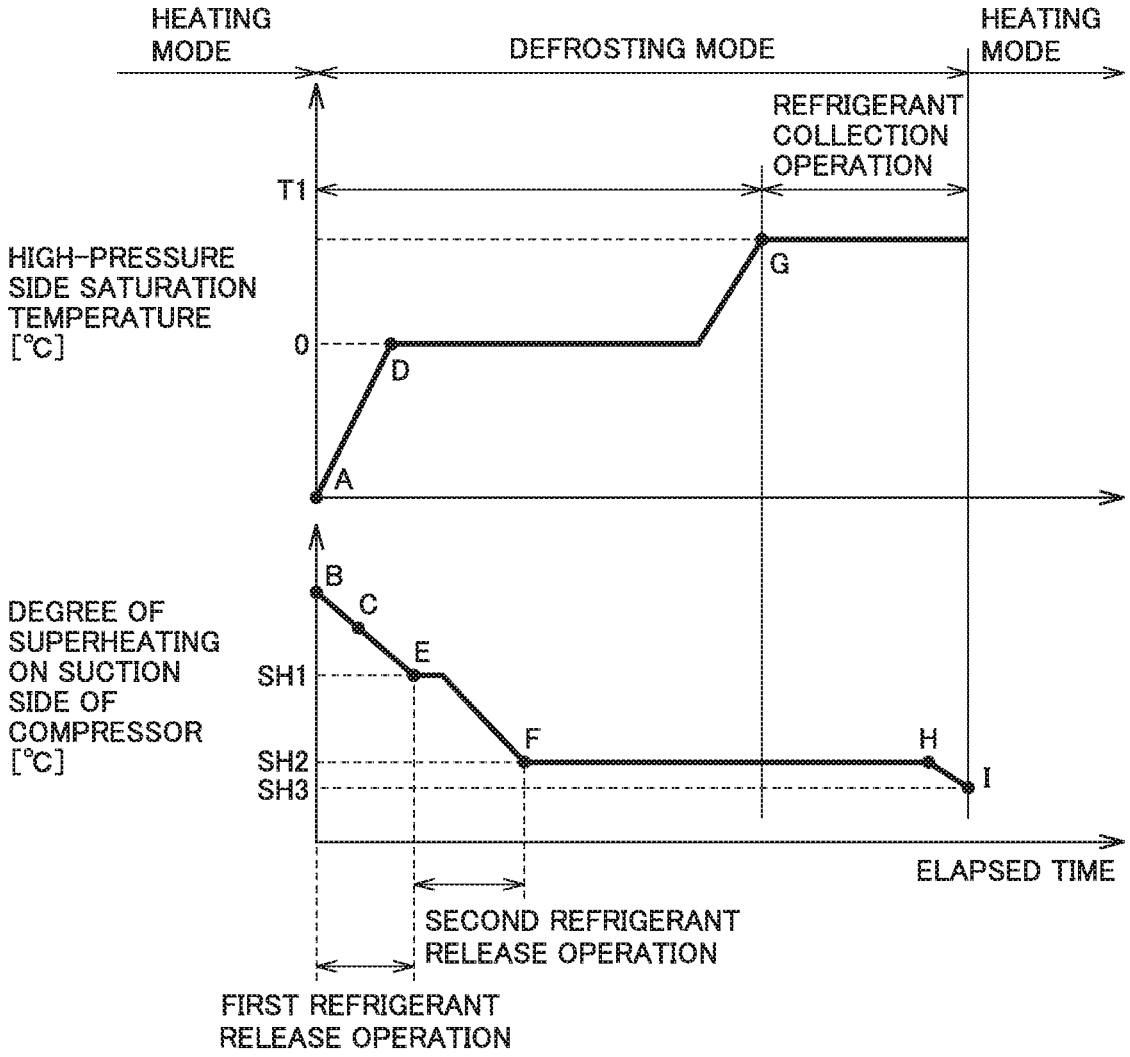
FIG. 12 is a diagram illustrating a high-pressure saturation temperature and a state of a degree of superheating on a suction side of the compressor in the defrosting mode in the first embodiment of the present invention.
Figure 13:
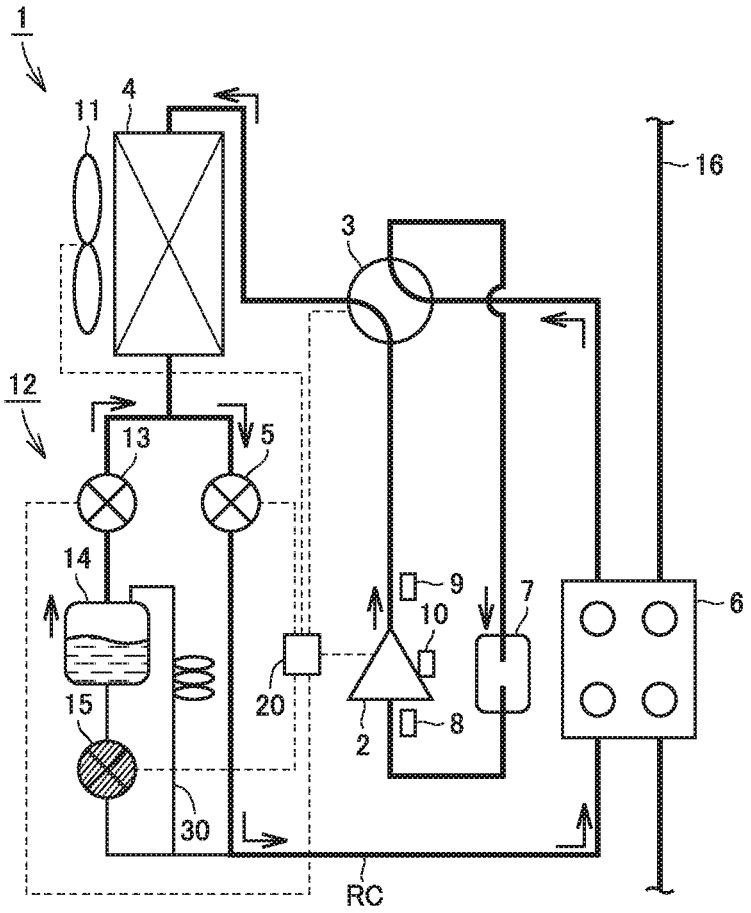
FIG. 13 is a circuit configuration diagram showing a flow of refrigerant in a first refrigerant release operation in the defrosting mode of the refrigeration cycle apparatus in the first embodiment of the present invention.

As shown in FIG. 13, as valve 15 of refrigerant tank circuit 12 is closed and flow rate regulation apparatus 13 is opened, refrigerant tank 14 is connected to the high-pressure side of refrigerant circuit RC. Refrigerant circuit RC is in a state immediately after inversion of a low pressure and a high pressure, and the inside of refrigerant tank 14 which has been connected to the high-pressure side in the heating mode until immediately before is in a relatively high-pressure state. Therefore, liquid refrigerant is released from refrigerant tank 14. Then, as shown with a point C in FIG. 12, a degree of superheating on the suction side of compressor 2 abruptly lowers. As shown with a point D in FIG. 12, as the first refrigerant release operation proceeds, the high-pressure saturation temperature increases to a inciting point (0° C.) of frost. The refrigerant stored in refrigerant tank 14 also circulates through refrigerant circuit RC so that defrosting capability is enhanced.

As shown with a point E in FIG. 12, when the degree of superheating on the suction side of compressor 2 lowers to a threshold value SH1 which is a liquid release end criterion threshold value, control device 20 determines that release of the refrigerant in refrigerant tank 14 has been completed and quits the first refrigerant release operation. As shown in FIG. 11, when the first refrigerant release operation ends, flow rate regulation apparatus 13 is closed.

[Defrosting Mode-Second Refrigerant Release Operation]

Since refrigerant tank 14 releases the refrigerant toward the high-pressure side of refrigerant circuit RC in the first refrigerant release operation as described previously, liquid back is suppressed as compared with a case of release of the refrigerant toward the low-pressure side. When the inside of refrigerant tank 14 and the high-pressure side are equal to each other in pressure, however, the refrigerant may remain in refrigerant tank 14, in order to further enhance defrosting capability, a second refrigerant release operation for releasing the refrigerant which remains in refrigerant tank 14 is performed.

As shown in FIG. 11, in the second refrigerant release operation, flow rate regulation apparatus 13 is controlled to the closed state and valve 15 is controlled to the opened state. Though compressor 2 is maintained in such a state that its operation capacity is high in the example in FIG. 11, control of capability of compressor 2 is not limited. Control of a degree of superheating of decompressing apparatus 5 is continued.

Figure 14:
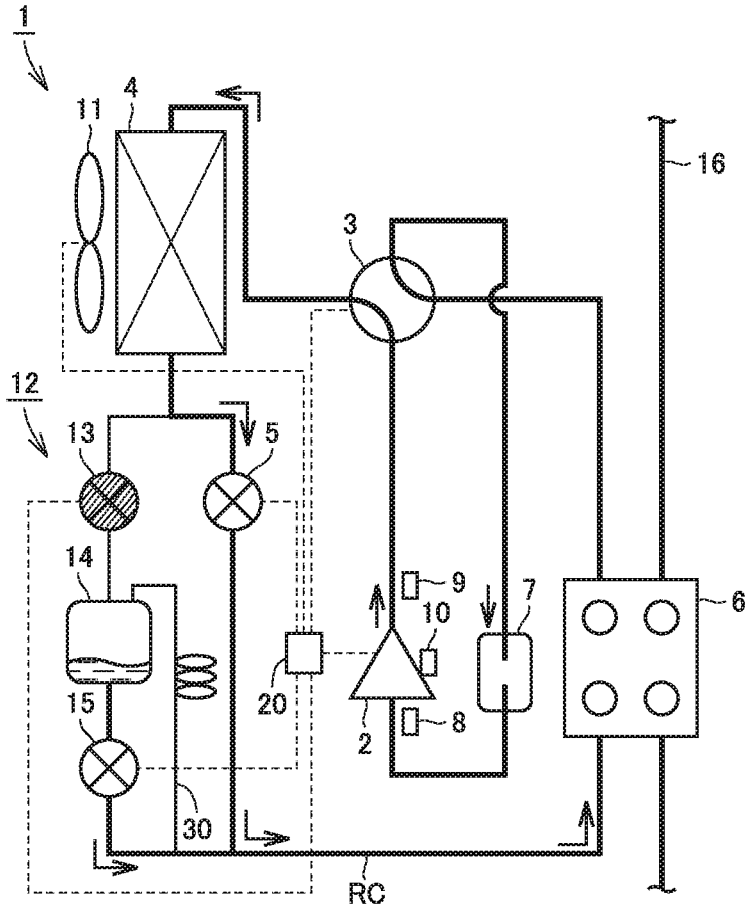
FIG. 14 is a circuit configuration diagram showing a flow of refrigerant in a second refrigerant release operation in the defrosting mode of the refrigeration cycle apparatus in the first embodiment of the present invention.

As shown in FIG. 14, by opening valve 15 of refrigerant tank circuit 12 and closing flow rate regulation apparatus 13, refrigerant tank 14 is connected to the low-pressure side of refrigerant circuit RC. The refrigerant which remains in refrigerant tank 14 is released due to a difference in pressure between the inside of refrigerant tank 14 and a downstream side of valve 15 (a downstream side of decompressing apparatus 5).

As shown in FIG. 12, when the second refrigerant release operation is started, the refrigerant which remains in refrigerant tank 14 is released and the degree of superheating on the suction side of compressor 2 lowers. As shown with a point F in FIG. 12, when the degree of superheating on the suction side of compressor 2 lowers to a threshold value SH2 which is a liquid release end criterion threshold value, control device 20 determines that release of the refrigerant in refrigerant tank 14 has been completed and quits the second refrigerant release operation. When the second refrigerant release operation ends, valve 15 is closed.

[Defrosting Mode-Continued Defrosting Operation]

When release of the refrigerant from refrigerant tank 14 ends, a continued defrosting operation is performed. As shown in FIG. 11, in the continued defrosting operation, flow rate regulation apparatus 13 and valve 15 are controlled to the closed state. Control of compressor 2 and decompressing apparatus 5 similar to before is continued.

The operation in the defrosting mode promotes melting of frost which has adhered to first heat exchanger 4 and the high-pressure saturation temperature increases as shown in FIG. 12. As shown with a point G in FIG. 12, when the high-pressure saturation temperature reaches a threshold value T1 representing a defrosting end criterion threshold value, control device 20 determines that defrosting has been completed and quits the continued defrosting operation.

[Defrosting Mode-Refrigerant Collection Operation]

As described above, in the defrosting mode, defrosting capability is improved by circulating the refrigerant in refrigerant tank 14. In returning to the heating mode, the refrigerant collection operation in which the refrigerant excessive in the heating mode is collected to refrigerant tank 14 is performed.

As shown in FIG. 11, in the refrigerant collection operation, flow rate regulation apparatus 13 and valve 15 are controlled to the opened state. Flow path switching apparatus 3 is maintained in such a state that the discharge side of compressor 2 is connected to first heat exchanger 4. Control of a degree of superheating of decompressing apparatus 5 is continued. Compressor 2 is relatively low in operation capacity. Since operation capability of compressor 2 is lowered in the refrigerant collection operation in the present embodiment, a speed of circulation of the refrigerant is low and the refrigerant tends to be stored in refrigerant tank 14.

When refrigerant tank 14 is full owing to the refrigerant collection operation, liquid refrigerant flows in on a downstream side of second heat exchanger 6 and the degree of superheating on the suction side of compressor 2 stars to lower as shown with a point H in FIG. 12. When the degree of superheating on the suction side of compressor 2 lowers to a threshold value SH3 representing a collection end criterion threshold value by making use of a phenomenon as shown with a point I in FIG. 12, control device 20 determines that refrigerant tank 13 is full and quits the refrigerant collection operation.

Though an example in which the continued defrosting operation is performed between the refrigerant release operation and the refrigerant collection operation is shown in FIG. 11, frost may also totally be molten during the refrigerant release operation depending on an amount of frost which adheres in first heat exchanger 4. Therefore, when control device 20 detects the high-pressure saturation temperature reaching T1 representing the defrosting end criterion threshold value during the refrigerant release operation, control device 20 stops the refrigerant release operation and makes transition to the refrigerant collection operation.

[Resumption of Heating Mode]

As shown in FIG. 11, when the defrosting mode ends, the heating mode is resumed. Specifically, capability of compressor 2 is controlled depending on a required load. Since second heat exchanger 6 defined as the use side heat exchanger has been cooled in the defrosting mode, in general, compressor 2 is operated with its operation capability being high at the time of resumption of the heating mode. Flow path switching apparatus 3 allows connection of the discharge side of compressor 2 to second heat exchanger 6. Control of the degree of superheating of decompressing apparatus 5 is continued. Flow rate regulation apparatus 13 of refrigerant tank circuit 12 is fully closed or set to an opening position close to the fully closed state and valve 15 is opened.

As set forth above, according to the present embodiment, since the refrigerant in refrigerant tank 14 is released in the defrosting mode, an amount of refrigerant which circulates through refrigerant circuit RC increases and defrosting capability can be enhanced. With defrosting capability being enhanced, a time period for the defrosting operation can be shortened.

The refrigerant collection operation may end based on subcooling (a degree of subcooling) at an exit of first heat exchanger 4. The refrigerant collection operation may end when subcooling at the exit of first heat exchanger 4 is equal to or smaller than a prescribed value. Specifically, subcooling at the exit of first heat exchanger 4 is measured, and the refrigerant collection operation may end when subcooling is towered to the prescribed value.

A function and effect of the refrigeration cycle apparatus in the present embodiment will now be described.

According to refrigeration cycle apparatus 1 in the present embodiment, refrigerant tank circuit 12 is connected to first heat exchanger 4 and second heat exchanger 6 in parallel with decompressing apparatus 5. Therefore, refrigerant is stored in refrigerant tank 14 and hence an amount of refrigerant which flows through refrigerant circuit RC can be reduced. The refrigerant excessive in heating can thus be collected to refrigerant tank 14. Degassing pipe 30 has first end 30*a* connected to refrigerant tank 14 and has second end 30*b* connected to at least any of refrigerant circuit RC and refrigerant tank circuit 12. Therefore, gas refrigerant in refrigerant tank 14 can escape through degassing pipe 30. Therefore, blocking of inflow of liquid refrigerant by the gas refrigerant in refrigerant tank 14 is suppressed. Therefore, the liquid refrigerant can sufficiently be collected to refrigerant tank 14. Thus, inflow into compressor 2 of the liquid refrigerant which flows in refrigerant circuit RC can be suppressed. Therefore, occurrence of liquid back can be suppressed. Therefore, failure of compressor 2 due to liquid back can be suppressed.

In refrigeration cycle apparatus 1 in the present embodiment, degassing pipe 30 has second end 30*b* connected to at least any of refrigerant circuit RC and refrigerant tank circuit 12 between refrigerant tank 14 and second heat exchanger 6. Therefore, degassing pipe 30 has second end 30*b* connected to the low-pressure side of refrigerant circuit RC. The gas refrigerant in refrigerant tank 14 can thus escape through degassing pipe 30 to the low-pressure side of refrigerant circuit RC. Therefore, the liquid refrigerant can reliably be collected to refrigerant tank 14.

In refrigeration cycle apparatus 1 in the present embodiment, valve 15 of refrigerant tank circuit 12 is arranged between refrigerant tank 14 and second heat exchanger 6. Therefore, storage of the liquid refrigerant in refrigerant tank 14 can be facilitated by closing valve 15.

In refrigeration cycle apparatus 1 in the present embodiment, an amount of refrigerant which flows through refrigerant circuit RC can be reduced. Therefore, refrigeration cycle apparatus 1 can be configured without accumulator 7. In refrigeration cycle apparatus 1, accumulator 7 can be reduced in size even though accumulator 7 is provided. Therefore, a machine compartment of refrigeration cycle apparatus 1 where accumulator 7 is generally installed can be reduced in size. Therefore, refrigeration cycle apparatus 1 can be space-saving. A weight of refrigeration cycle apparatus 1 can thus be reduced. A footprint of refrigeration cycle apparatus 1 can be made smaller. An amount of refrigerant of refrigeration cycle apparatus 1 can be reduced.

Second Embodiment

Figure 15:
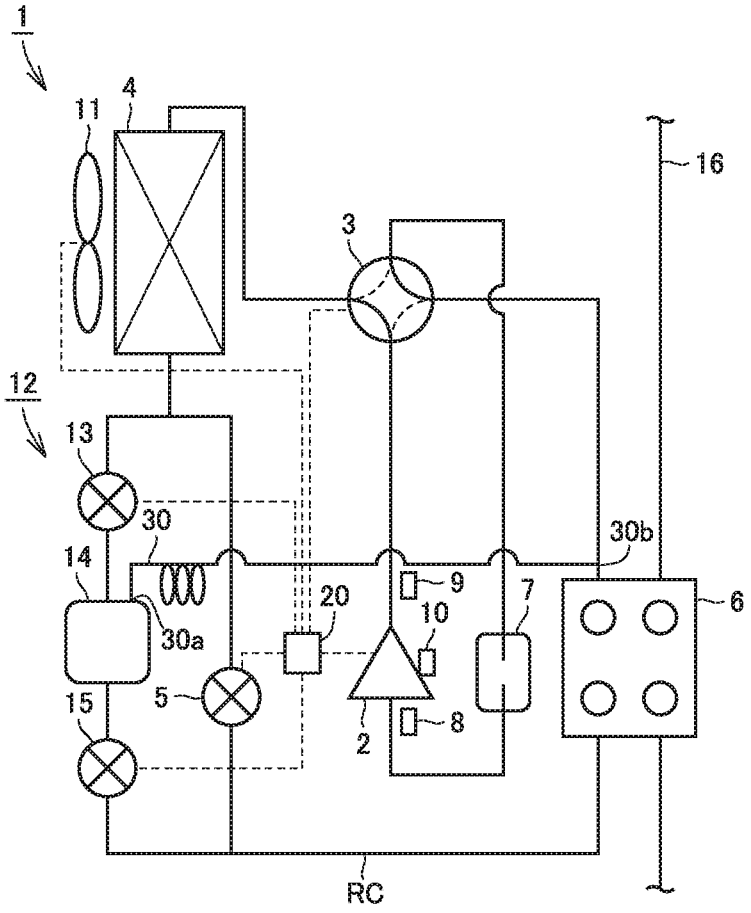
FIG. 15 is a circuit configuration diagram of a refrigeration cycle apparatus in a second embodiment of the present invention.

A configuration of refrigeration cycle apparatus 1 in a second embodiment of the present invention will be described with reference to FIG. 15. Features the same as in the first embodiment have the same reference characters allotted and description will not be repeated unless otherwise specified, which is also applicable to third to sixth embodiments.

In refrigeration cycle apparatus 1 in the present embodiment, degassing pipe 30 has second end 30*b* connected to refrigerant circuit RC between second heat exchanger 6 and compressor 2. In FIG. 15, degassing pipe 30 has second end 30*b* connected to refrigerant circuit RC between second heat exchanger 6 and flow path switching apparatus 3. Degassing pipe 30 has second end 30*b* connected downstream from second heat exchanger 6 and on a low-pressure side relative to refrigerant tank 14 in refrigerant circuit RC.

Figure 16:
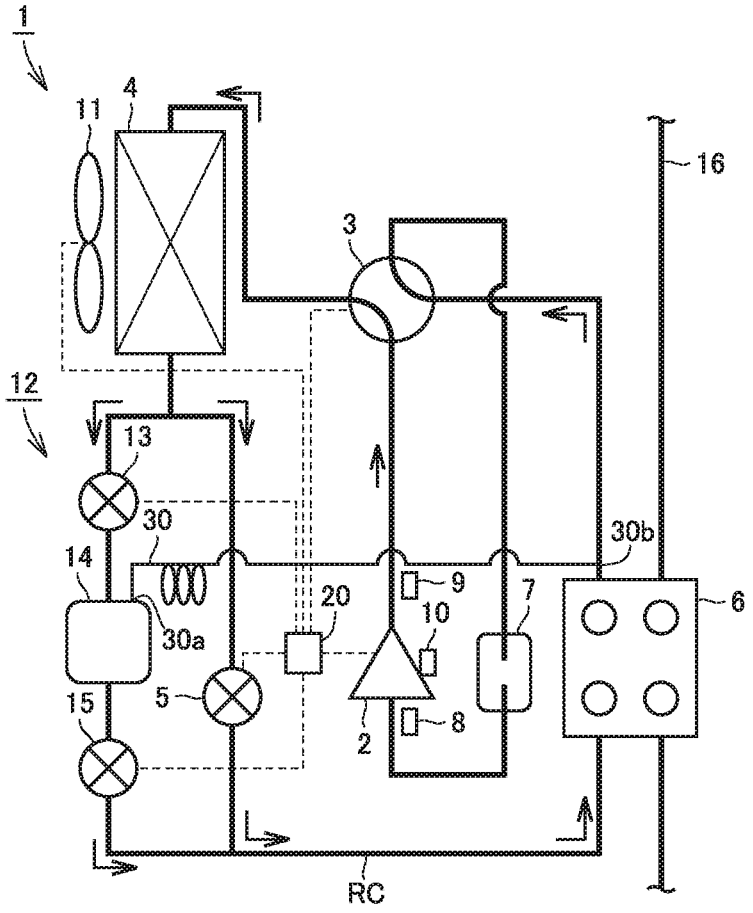
FIG. 16 is a circuit configuration diagram showing a flow of refrigerant in one example of the refrigerant collection operation of the refrigeration cycle apparatus in the second embodiment of the present invention.

Referring, to FIG. 16, the refrigeration cycle apparatus in the present embodiment, degassing pipe 30 has second end 30*b* connected downstream from second heat exchanger 6 and on the low-pressure side relative to refrigerant tank 14 in refrigerant circuit RC. Therefore, gas refrigerant in refrigerant tank 14 escapes through degassing pipe 30 toward a lower-pressure side of refrigerant circuit RC.

In refrigeration cycle apparatus 1 in the present embodiment, degassing pipe 30 has second end 30*b* connected to refrigerant circuit RC between second heat exchanger 6 and compressor 2. Therefore, degassing pipe 30 has second end 30*b* connected to the lower-pressure side of refrigerant circuit RC. Gas refrigerant in refrigerant tank 14 can thus escape through degassing pipe 30 toward the lower-pressure side of refrigerant circuit RC. Therefore, liquid refrigerant can more reliably be collected to refrigerant tank 14. A time period for collection of the liquid refrigerant can be shortened.

Third Embodiment

Figure 17:
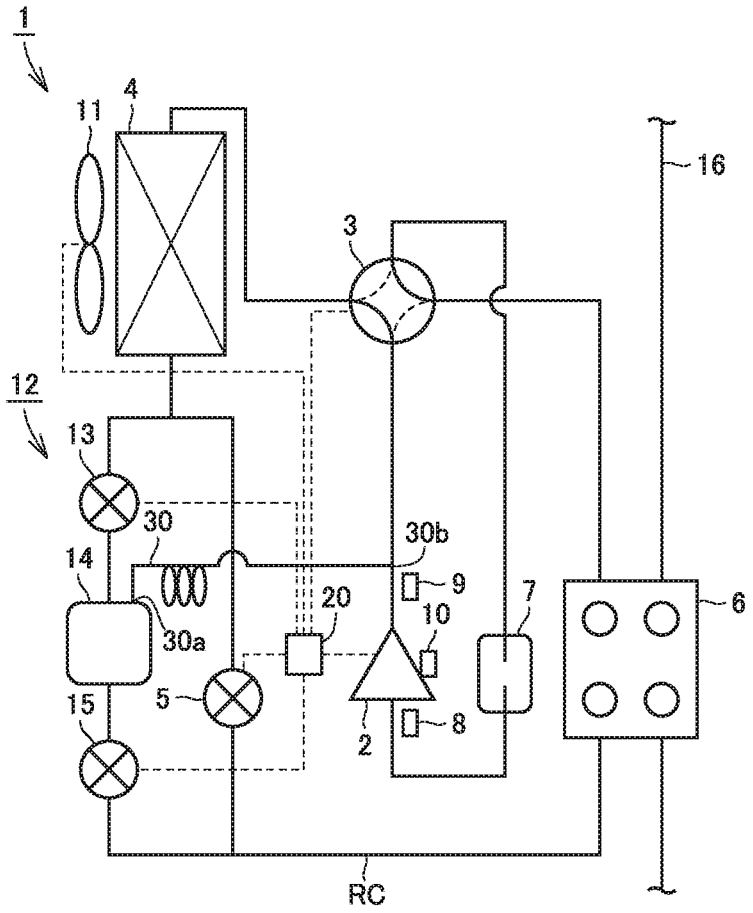
FIG. 17 is a circuit configuration diagram of a refrigeration cycle apparatus in a third embodiment of the present invention.

A configuration of refrigeration cycle apparatus 1 in a third embodiment of the present invention will be described with reference to FIG. 17. In refrigeration cycle apparatus 1 in the present embodiment, degassing pipe 30 has second end 30*b* connected to refrigerant circuit RC between compressor 2 and first heat exchanger 4. In FIG. 17, degassing pipe 30 has second end 30*b* connected to refrigerant circuit RC between compressor 2 and flow path switching apparatus 3. Degassing pipe 30 has second end 30*b* connected downstream from compressor 2 and on the high-pressure side relative to refrigerant tank 14 in refrigerant circuit RC.

Figure 18:
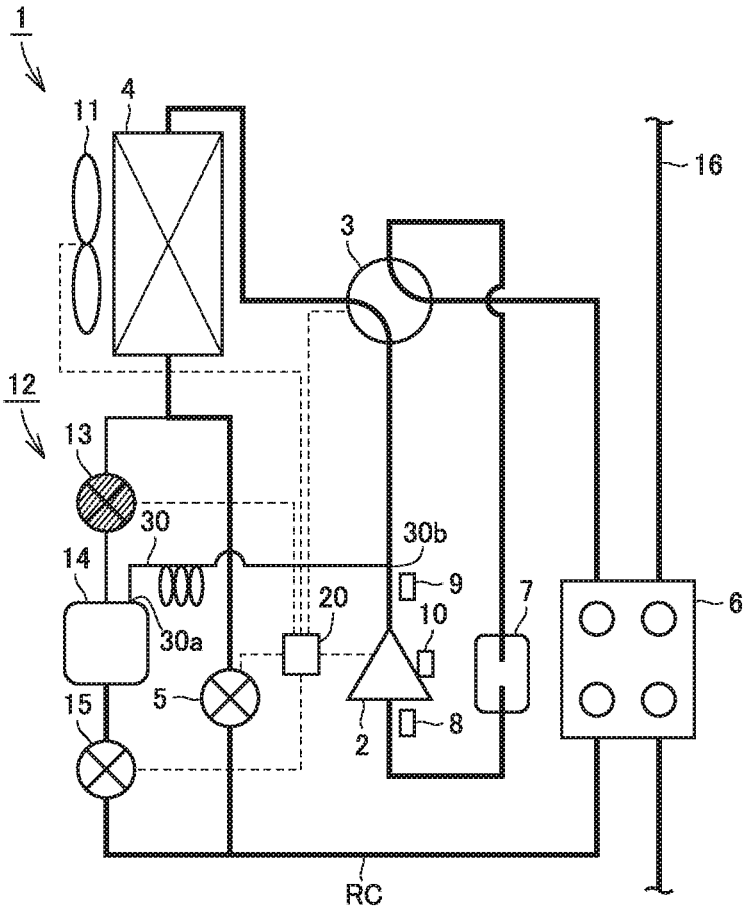
FIG. 18 is a circuit configuration diagram showing a flow of refrigerant in one example of the refrigerant release operation of the refrigeration cycle apparatus in the third embodiment of the present invention.

Referring to FIG. 18, in the refrigeration cycle apparatus in the present embodiment, degassing pipe 30 has second end 30*b* connected downstream from compressor 2 and on the high-pressure side relative to refrigerant tank 14 in refrigerant circuit RC. Therefore, a pressure of gas refrigerant discharged from compressor 2 is applied to the inside of refrigerant tank 14 through degassing pipe 30. Flow rate regulation apparatus 13 is closed and valve 15 is opened. Therefore, the liquid refrigerant is released from refrigerant tank 14 while the pressure of the gas refrigerant discharged from compressor 2 is applied to the inside of refrigerant tank 14 through degassing pipe 30.

In refrigeration cycle apparatus 1 in the present embodiment, degassing pipe 30 has second end 30*b* connected to refrigerant circuit RC between compressor 2 and first heat exchanger 4. Therefore, a pressure of the gas refrigerant discharged from compressor 2 is applied to the inside of refrigerant tank 14 through degassing pipe 30. Thus, when liquid refrigerant is released from refrigerant tank 14 in the cooling mode, refrigerant tank 14 can reliably be evacuated. When the liquid refrigerant is similarly released from refrigerant tank 14 also in the defrosting mode, refrigerant tank 14 can reliably be evacuated.

Fourth Embodiment

Figure 19:
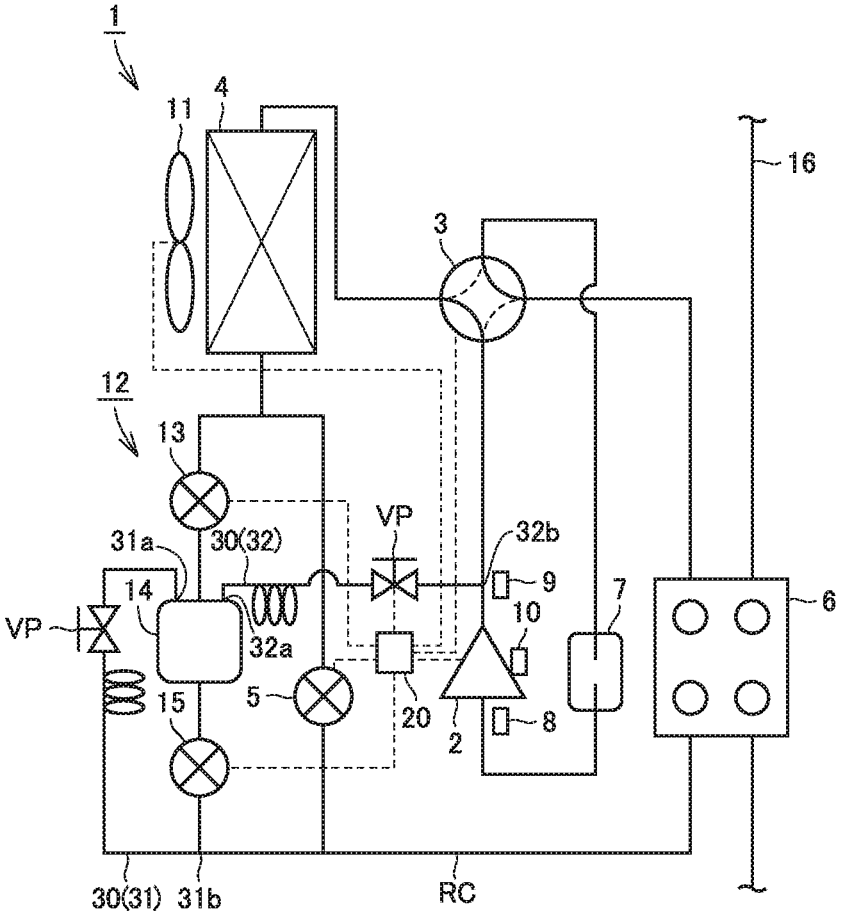
FIG. 19 is a circuit configuration diagram of a refrigeration cycle apparatus in a fourth embodiment of the present invention.

A configuration of refrigeration cycle apparatus 1 in a fourth embodiment of the present invention will be described with reference to FIG. 19. In refrigeration cycle apparatus 1 in the present embodiment, degassing pipe 30 is provided with a first pipe portion 31, a second pipe portion 32, and a valve portion VP. First pipe portion 31 has a first end 31*a* and a second end 31*b*. Second pipe portion 32 has a first end 32*a* and a second end 32*b*.

First pipe portion 31 has first end 31.*a* connected to refrigerant tank 14. First pipe portion 31 has first end 31*a* connected to the upper surface of refrigerant tank 14. First pipe portion 31 has second end 31*b* connected to at least any of refrigerant circuit RC and refrigerant tank circuit 12 between refrigerant tank 14 and second heat exchanger 6. In FIG. 19, first pipe portion 31 has second end 31*b* connected to refrigerant tank circuit 12 between refrigerant tank 14 and second heat exchanger 6. First pipe portion 31 has second end 31*b* connected downstream from valve 15 in refrigerant tank circuit 12.

Second pipe portion 32 has first end 32*a* connected to refrigerant tank 14. Second pipe portion 32 has first end 32*a* connected to the upper surface of refrigerant tank 14. Second pipe portion 32 has second end 32*b* connected to refrigerant circuit RC between compressor 2 and first heat exchanger 4, in FIG. 19, second pipe portion 32 has second end 30*b* connected to refrigerant circuit RC between compressor 2 and flow path switching apparatus 3. Second pipe portion 32 has second end 32*b* connected downstream from compressor 2 and on the high-pressure side relative to refrigerant tank 14 in refrigerant circuit RC.

Valve portion VP is configured to allow refrigerant to flow to one of first pipe portion 31 and second pipe portion 32 and not to allow the refrigerant to the other thereof. Valve portion VP is connected between first end 31*a* and second end 31*b* of first pipe portion 31. Valve portion VP is connected also between first end 32*a* and second end 32*b* of second pipe portion 32. Valve portion VP has a valve disc and switches between a conducting state and a non-conducting state of the refrigerant by switching between an opened state and a closed state of the valve disc. For example, a bidirectional solenoid valve can be employed for valve portion VP. Valve portion VP is electrically connected to control device 20. An operation of valve portion VP is controlled by control device 20.

Figure 20:
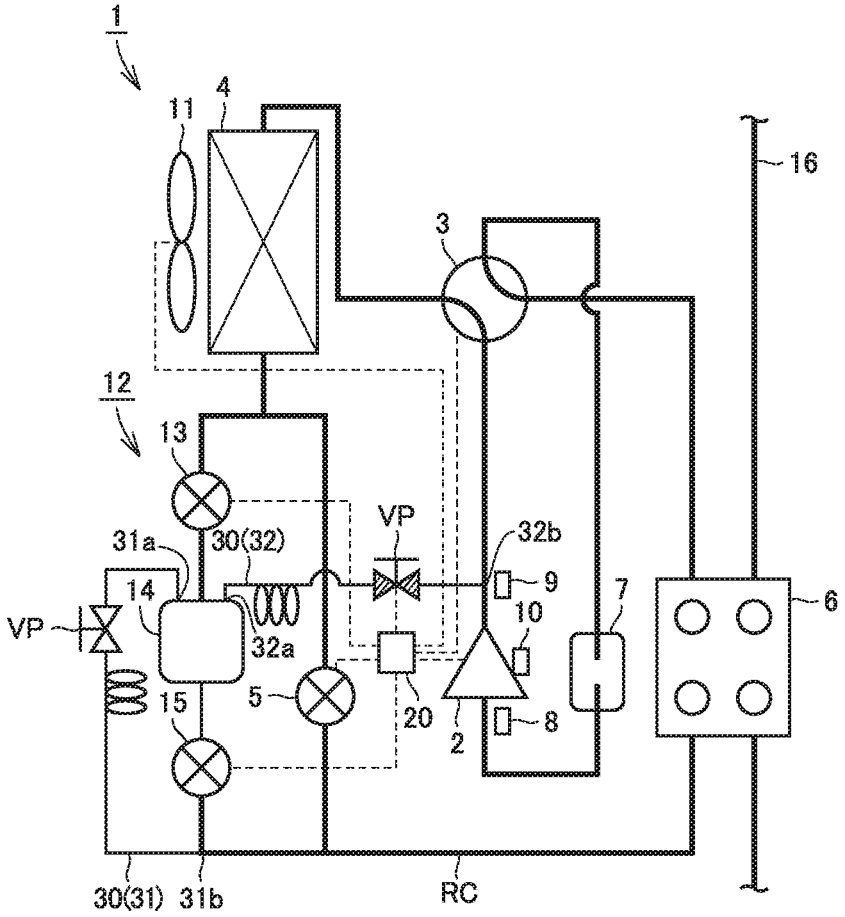
FIG. 20 is a circuit configuration diagram showing a state that refrigerant flows through a first pipe portion of the refrigeration cycle apparatus in the fourth embodiment of the present invention.

Referring to FIG. 20, valve portion VP connected to first pipe portion 31 is opened and valve portion VP connected to second pipe portion 32 is closed, so that liquid refrigerant can sufficiently be stored in refrigerant tank 14 in the refrigerant collection operation.

Figure 21:
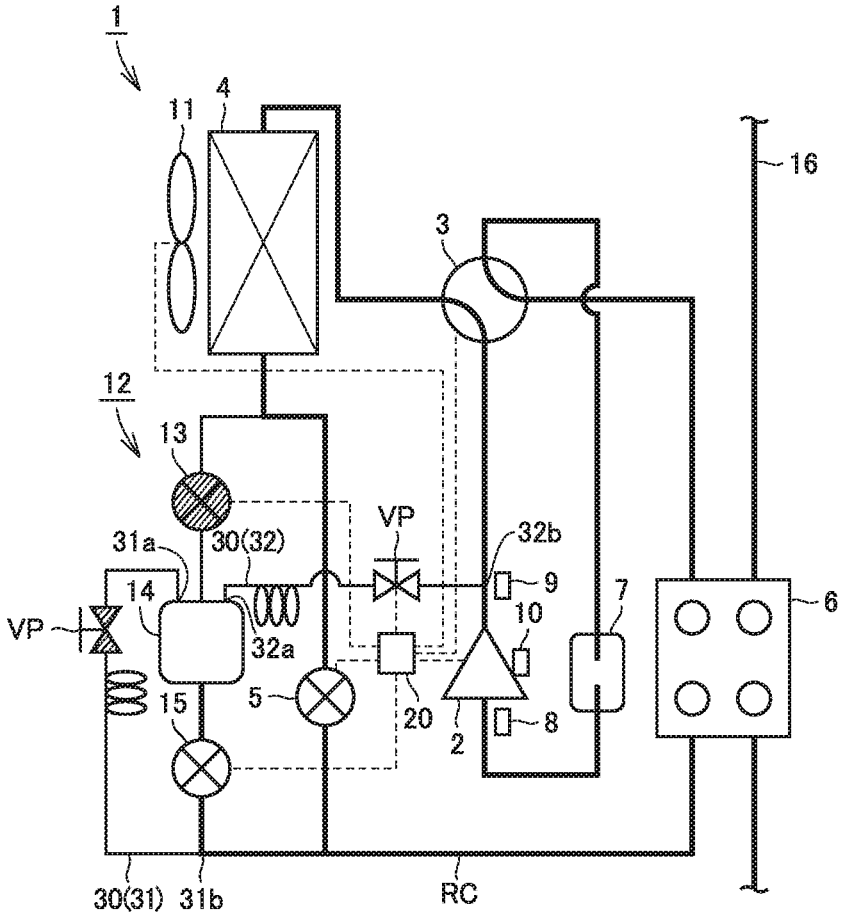
FIG. 21 is a circuit configuration diagram showing a state that refrigerant flows through a second pipe portion of the refrigeration cycle apparatus in the fourth embodiment of the present invention.

Referring to FIG. 21, valve portion VP connected to first pipe portion 31 is closed and valve portion VP connected to second pipe portion 32 is opened, so that a pressure of gas refrigerant discharged from compressor 2 is applied to the inside of refrigerant tank 14 through second pipe portion 32 when liquid refrigerant is released from refrigerant tank 14.

In refrigeration cycle apparatus 1 in the present embodiment, valve portion VP connected to first pipe portion 31 is opened and valve portion VP connected to second pipe portion 32 is closed, so that liquid refrigerant can sufficiently be stored in refrigerant tank 14 in the refrigerant collection operation. Flow into compressor 2 of liquid refrigerant which flows through refrigerant circuit RC can thus be suppressed. Valve portion VP connected to first pipe portion 31 is closed and valve portion VP connected to second pipe portion 32 is opened, so that a pressure of gas refrigerant discharged from compressor 2 is applied to the inside of refrigerant tank 14 through second pipe portion 32 when liquid refrigerant is released from refrigerant tank 14. Refrigerant tank 14 can thus reliably be evacuated when liquid refrigerant is released from refrigerant tank 14. By switching valve portion VP, in refrigerant collection operation, flow into compressor 2 of liquid refrigerant which flows in refrigerant circuit RC can be suppressed and refrigerant tank 14 can reliably be evacuated when liquid refrigerant is released from refrigerant tank 14.

Fifth Embodiment

Figure 22:
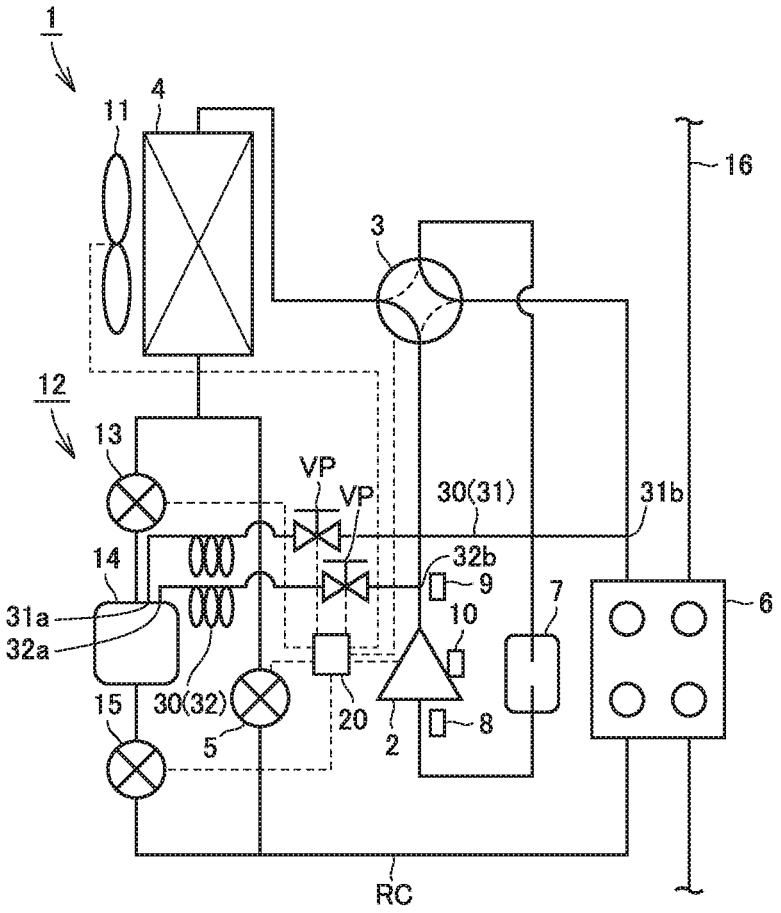
FIG. 22 is a circuit configuration diagram of a refrigeration cycle apparatus in a fifth embodiment of the present invention.

A configuration of refrigeration cycle apparatus 1 in a fifth embodiment of the present invention will be described with reference to FIG. 22. In refrigeration cycle apparatus 1 in the present embodiment, degassing pipe 30 is provided with first pipe portion 31, second pipe portion 32, and valve portion VP. First pipe portion 31 has first end 31*a* and second end 31*b*. Second pipe portion 32 has first end 32*a* and second end 32*b*.

First pipe portion 31 has first end 31*a* connected to refrigerant tank 14. First pipe portion 31 has first end 31*a* connected to the upper surface of refrigerant tank 14. First pipe portion 31 has second end 31*b* connected to refrigerant circuit RC between second heat exchanger 6 and compressor 2. In FIG. 22, first pipe portion 31 has first end 31*a* connected to refrigerant circuit RC between second heat exchanger 6 and flow path switching apparatus 3. First pipe portion 31 has second end 31*b* connected downstream from second heat exchanger 6 and on the low-pressure side relative to refrigerant tank 14 in refrigerant circuit RC.

Second pipe portion 32 has first end 32*a* connected to refrigerant tank 14. Second pipe portion 32 has first end 32*a* connected to the upper surface of refrigerant tank 14. Second pipe portion 32 has second end 32*b* connected to refrigerant circuit RC between compressor 2 and first heat exchanger 4. In FIG. 12, second pipe portion 32 has second end 30*b* connected to refrigerant circuit RC between compressor 2 and flow path switching apparatus 3. Second pipe portion 32 has second end 32*b* connected downstream from compressor 2 and on the high-pressure side relative to refrigerant tank 14 in refrigerant circuit RC.

Valve portion VP is configured to allow refrigerant to flow to one of first pipe portion 31 and second pipe portion 32 and not to allow the refrigerant to flow to the other thereof. Valve portion VP is connected between first end 31*a* and second end 31*b* of first pipe portion 31. Valve portion VP is connected also between first end 31*a* and second end 31*b* of first pipe portion 31. Valve portion VP has a valve disc and switches between a conducting state and a non-conducting state of the refrigerant by switching between the opened state and the closed state of the valve disc. For example, a bidirectional solenoid valve can be employed for valve portion VP. Valve portion VP is electrically connected to control device 20. An operation of valve portion VP is controlled by control device 20.

Figure 23:
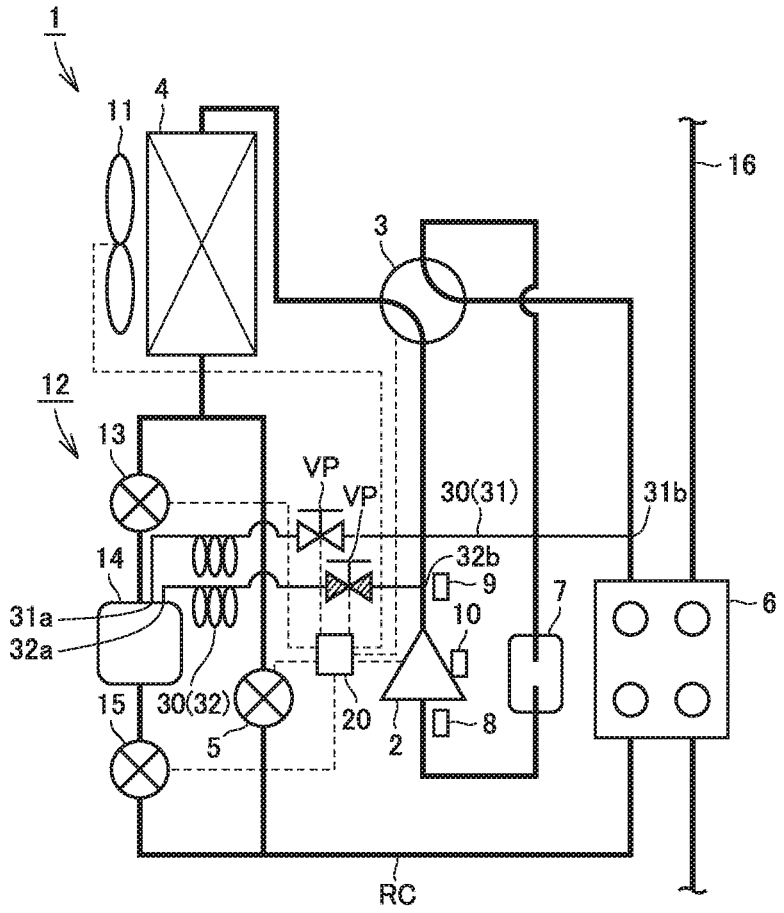
FIG. 23 is a circuit configuration diagram showing a state that refrigerant flows through the first pipe portion of the refrigeration cycle apparatus in the fifth embodiment of the present invention.

Referring to FIG. 23, valve portion VP connected to first pipe portion 31 is opened and valve portion VP connected to second pipe portion 32 is closed, so that gas refrigerant in refrigerant tank 14 can escape through first pipe portion 31 toward the lower-pressure side of refrigerant circuit RC.

Figure 24:
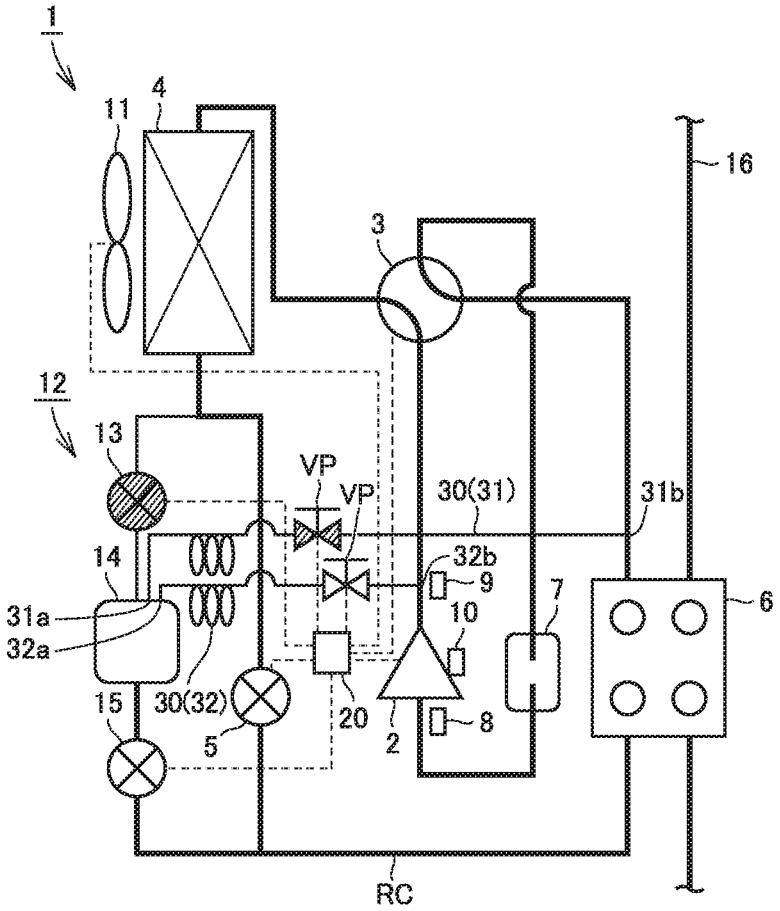
FIG. 24 is a circuit configuration diagram showing a state that refrigerant flows through the second pipe portion of the refrigeration cycle apparatus in the fifth embodiment of the present invention.

Referring to FIG. 24, valve portion VP connected to first pipe portion 31 is closed and valve portion VP connected to second pipe portion 32 is opened, so that a pressure of gas refrigerant discharged from compressor 2 is applied to the inside of refrigerant tank 14 through second pipe portion 32 when liquid refrigerant is released from refrigerant tank 14.

In refrigeration cycle apparatus 1 in the present embodiment, valve portion VP connected to first pipe portion 31 is opened and valve portion VP connected to second pipe portion 32 is closed, so that gas refrigerant in refrigerant tank 14 can escape through first pipe portion 31 to the lower pressure side of refrigerant circuit RC in the refrigerant collection operation. The liquid refrigerant can thus more reliably be collected to refrigerant tank 14. Valve portion VP connected to first pipe portion 31 is closed and valve portion VP connected to second pipe portion 32 is opened, so that a pressure of gas refrigerant discharged from compressor 2 is applied to the inside of refrigerant tank 14 through second pipe portion 32 when liquid refrigerant is released from refrigerant tank 14. Thus, refrigerant tank 14 can reliably be evacuated when liquid refrigerant is released from refrigerant tank 14. By switching valve portion VP, in the refrigerant collection operation, liquid refrigerant can more reliably be collected to refrigerant tank 14 and refrigerant tank 14 can reliably be evacuated when liquid refrigerant is released from refrigerant tank 14.

Sixth Embodiment

Figure 25:
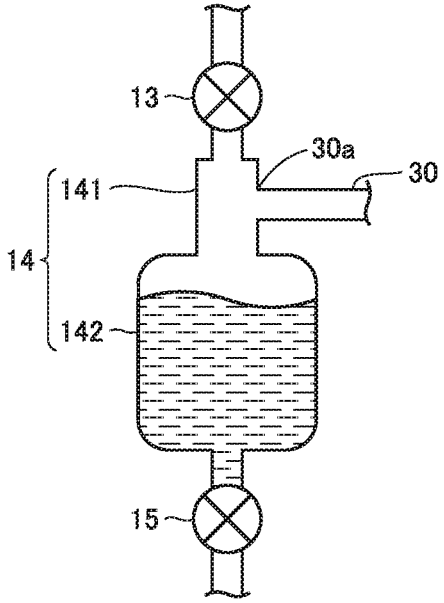
FIG. 25 is a cross-sectional view showing a configuration of a refrigerant tank of a refrigeration cycle apparatus in a sixth embodiment of the present invention.

A configuration of refrigerant tank 14 of refrigeration cycle apparatus 1 in a sixth embodiment of the present invention will be described with reference to FIG. 25.

In refrigeration cycle apparatus 1 in the present embodiment, refrigerant tank 14 is provided with a main body portion 141 and a tubular portion 142 connected to main body portion 141. Tubular portion 142 is arranged on a side of first heat exchanger 4 shown in FIG. 1 relative to main body portion 141. Tubular portion 142 is connected to first heat exchanger 4 through a pipe. Main body portion 141 is connected to first heat exchanger 4 with tubular portion 142 being interposed. Degassing pipe 30 has first end 30*a* connected to tubular portion 142. For example, a T tube can be employed for tubular portion 142. Tubular portion 142 has an inner diameter, for example, not smaller than 25 mm and not greater than 35 mm. As the inner diameter is greater, efficiency in gas-liquid separation of refrigerant can be improved.

In refrigeration cycle apparatus 1 in the present embodiment, degassing pipe 30 has first end 30*a* connected to tubular portion 142. Therefore, degassing pipe 30 is not connected to main body portion 141. Therefore, a hole for degassing pipe 30 does not have to be provided in refrigerant tank 14. Therefore, a structure for connection between refrigerant tank 14 and degassing pipe 30 is simplified. Therefore, cost can be reduced.

It should be understood that the embodiments disclosed herein are illustrative and non-restrictive in every respect. The scope of the present invention is defined by the terms of the claims rather than the description above and is intended to include any modifications within the scope and meaning equivalent to the terms of the claims.

REFERENCE SIGNS LIST

1 refrigeration cycle apparatus; 2 compressor; 3 path switching apparatus; 4 first heat exchanger; 5 decompressing apparatus; 6 second heat exchanger; 7 accumulator; 8 suction pressure sensor; 9 discharge pressure sensor; 10 suction temperature sensor; 11 fan; 12 refrigerant tank circuit; 13 flow rate regulation apparatus; 14 refrigerant tank; 15 valve; 16 water circuit; 20 control device; 21 high-pressure saturation temperature detection unit; 22 superheating degree detection unit; 23 refrigerant tank liquid amount detection unit; 24 memory; 30 degassing pipe; 30*a*, 31*a*, 32*a* first end; 30*b*, 31*b*, 32*b* second end; 31 first pipe portion; 32 second pipe portion; 141 main body portion; 142 tubular portion; RC refrigerant circuit; and VP valve portion

The invention claimed is:

1. A refrigeration cycle apparatus comprising:

a refrigerant circuit configured by connecting a compressor, a flow path switching apparatus, a first heat exchanger, a decompressing apparatus, and a second heat exchanger;

a refrigerant tank circuit connected to the first and second heat exchangers in parallel with the decompressing apparatus; and a degassing pipe having a first end and a second end, wherein the flow path switching apparatus is configured to switch a flow of refrigerant discharged from the compressor to any of the first and second heat exchangers, the refrigerant tank circuit comprises a refrigerant tank, the first end of the degassing pipe is connected to the refrigerant tank, and the second end of the degassing pipe is connected to at least any of the refrigerant circuit and the refrigerant tank circuit between the refrigerant tank and the second heat exchanger, the refrigerant tank circuit further comprises a flow rate regulation apparatus and a valve, in a cooling mode, the flow rate regulation apparatus and the valve are fully closed, in a refrigerant collection operation, the flow rate regulation apparatus and the valve are opened or the flow rate regulation apparatus is opened and the valve is closed, and in a heating mode, the flow rate regulation apparatus is fully closed, and the valve is fully opened.

2. The refrigeration cycle apparatus according claim 1, wherein the refrigerant tank comprises a main body portion and a tubular portion connected to the main body portion, the tubular portion is arranged on a side of the first heat exchanger relative to the main body portion, and the first end of the degassing pipe is connected to the tubular portion.

3. The refrigeration cycle apparatus according to claim 1, wherein the valve is arranged between the refrigerant tank and the second heat exchanger.

* * * * *